US005335481A

United States Patent [19]

Ward

[11] Patent Number: 5,335,481

[45] Date of Patent: Aug. 9, 1994

[54] APPARATUS AND METHOD FOR AUTOMATIC PACKAGING OF PIPETTE TIPS

[76] Inventor: Glen N. Ward, 45450 Industrial Pl. #15, Fremont, Calif. 94538

[21] Appl. No.: 7,587

[22] Filed: Jan. 22, 1993

[51] Int. Cl.[5] ..... B65B 5/08; B65B 23/22; B65B 35/56; B65B 35/14

[52] U.S. Cl. ..... 53/446; 53/142; 53/246; 53/437; 53/534; 53/539

[58] Field of Search ..... 53/446, 444, 443, 473, 53/437, 534, 539, 525, 251, 250, 249, 246, 247, 236, 142, 143, 544

[56] References Cited

U.S. PATENT DOCUMENTS

| | | | |
|---|---|---|---|
| 1,062,848 | 5/1913 | Peterson | 53/142 |
| 1,063,588 | 6/1913 | Peterson | 53/142 |
| 3,853,217 | 12/1974 | Scordato et al. | 206/223 |
| 3,937,322 | 2/1976 | Cohen | 206/216 |
| 4,056,920 | 11/1977 | Shields | 53/246 X |
| 4,130,978 | 12/1978 | Cohen | 53/444 |
| 4,349,109 | 9/1982 | Scordato et al. | 206/562 |
| 4,498,273 | 2/1985 | Colamussi | 53/142 X |
| 4,555,892 | 12/1985 | Dijkman | 53/247 X |
| 5,057,282 | 10/1991 | Linder | 422/104 |

*Primary Examiner*—James F. Coan
*Attorney, Agent, or Firm*—Flehr, Hohbach, Test, Albritton & Herbert

[57] ABSTRACT

An apparatus for automated loading of pipette tips (26) into storage containers or racks (28). The apparatus (21, 21a) includes a tip-orienting roller assembly (22, 22a) for orienting the tips (26) in side-by-side contact and general parallel alignment, and a spacer assembly (24, 24a) which engages the tips (26) and pushes them from the orienting assembly (22) while simultaneously spacing them at a spacing suitable for insertion into a storage container or rack (28) having spaced apart tip-receiving openings (81). In the preferred embodiment, the tip orienting assembly (22) is provided by a vibratory feeder (30) which feeds a pair of spaced apart and inclined counter-rotating rollers (36, 37), and the spacer assembly (24) pushes the tips (26) between the rollers (36, 37) and into an intermediate transfer nest assembly (27, 27a). The nest assembly (27, 27a) transfers between the roller assembly (23) and the pipette tip rack or box (28). A method for automated loading of pipette tips (26) into storage and transport containers (28) also is provided.

61 Claims, 15 Drawing Sheets

APPARATUS AND METHOD FOR AUTOMATIC PACKAGING OF PIPETTE TIPS

TECHNICAL FIELD

The present invention relates, in general, to the packaging of large numbers of tubular or rod-like members, and more particularly, relates to the loading of disposable pipette tips into containers or racks for shipping, storage and dispensing of the tips.

BACKGROUND ART

In recent years the use of plastic, disposable pipette tips has expanded rapidly to the point that there now are literally millions of these tips used in the United States each year. The plastic tips are used with pipettors, and in most applications each tip is used once and then disposed of so as to avoid contamination and eliminate the need for cleaning of the tips. Thus, a single pipettor will be used with hundreds and even thousands of disposable tips in the course of a week.

Disposable, plastic pipette tips are typically packaged for shipment and for use and storage in rectangular or box-like containers or "racks" in which the tips are oriented vertically and positioned in a bore or opening in the rack with their open upper ends ready to receive the pipettor. U.S. Pat. Nos. 5,057,282, 4,349,109, 4,130,978, 3,937,322 and 3,853,217 are typical of various pipette tip racks or storage containers which can be used to package and ship the pipette tips and act as racks for dispensing of the tips. Most typically, these racks are loaded by hand in a relatively tedious operation. Since there typically will be 96 to 250 pipette tips per rack or layer in multi-layer containers, hand loading of the tips into the containers adds a significant cost to the disposable tips, which often have a sales price of only a few cents per tip. Moreover, handling of the tips, even with rubber gloves, exposes them to contamination, which for some tips will require subsequent sterilization while the tips are in the racks.

Automated packaging or loading of pipette tips, or other small tubular or elongated objects such as test tubes, into storage racks presents a difficult problem because of the number of the objects, their small size, their light weight and the close spacing which is required. Nevertheless, an automated packaging or rack-loading technique would be highly desirable in terms of both costs savings and contamination reduction.

Accordingly, it is an object of the present invention to provide an apparatus and method for automated loading of tubular or rod-like objects, and particularly pipette tips, into a shipping and storage container or rack.

It is a further object of the present invention to provide an apparatus and method for automatic loading of pipette tips which is highly reliable, easily adaptable to a variety of pipette tip sizes, requires minimum maintenance, and will operate at relatively high speed.

The apparatus and method of the present invention have other objects and features which will be apparent from or are set forth in more detail in the accompanying drawing and description of the Best Mode of Carrying Out the Invention.

DISCLOSURE OF INVENTION

The apparatus for automated loading of pipette tips into a container of the present invention comprises, briefly, a tip-orienting assembly formed to automatically reorient pipette tips from a random orientation to a common, side-by-side, substantially parallel and contacting orientation. Such tip-orientation assembly is preferably provided by a vibratory feeder which deposits tips onto a pair of elongated rollers mounted in spaced apart relation by a distance sufficient to enable the tips to be supported therebetween with the small ends of each tip extending down between the rollers. The apparatus of the present invention further includes a spacer assembly mounted proximate the tip-orienting assembly and having a plurality of spacer elements mounted for movement from a position out of engagement with the tips to a position into interengagement with the tips as supported on the tip-orienting assembly. The spacer elements are further movable when interengaged with the tips to space the tips in a predetermined spacing. Finally, the spacer assembly is further mounted for movement of the spacer elements while the tips are in the predetermined spacing until the tips are displaced into one of the container and a tip transfer assembly. In the preferred form, the spacer assembly pushes the tips between the tip-orienting rollers and into a transfer nest assembly. The tip-orienting rollers further are preferably mounted for rotation in a direction tending to lift the tips, and the rollers are inclined at an angle to the horizon to produce gravitation of the tips while supported on the rollers into side-by-side contacting relation.

The method of automated loading of pipette tips into a storage container is comprised of the steps of depositing a plurality of randomly oriented tips on a tip-orienting assembly, reorienting the tips into side-by-side, substantially parallel, contacting relation in which the spacing between tips is determined by the diameter of the tips, separating the tips from contact with each other to space the tips from each other at a spacing substantially equal to the spacing of tip-receiving openings in the container, and transferring the tips to the container while maintaining the spacing.

BEST MODE OF CARRYING OUT THE INVENTION

Pipette tips most typically are injection molded from a plastic, such as polypropylene, although they can also be formed from other materials including glass. The method and apparatus of the present invention is suitable for use with non-plastic members including glass pipette tips, although various apparatus and method steps employ the inherent flexibility and resiliency of the plastic. When used with non-resilient or glass pipette tips or test tubes, such portions of the apparatus and process would require that the apparatus, rather than the tips or tubes, be resiliently flexible. Since virtually all of the disposable pipette tips are formed from plastics, however, the present apparatus and method will be discussed in terms of its use in connection with plastic, disposable pipette tips.

Injection molding of pipette tips is usually accomplished in multiple cavity molds, with the hollow, usually tapered, pipette tips being stripped from the mold cores into a container in a random orientation. Thus, when done by hand, the packer must reach into a container filled with randomly oriented pipette tips and pick them out. The tips must be oriented with the small diameter ends down and placed in the respective openings in the storage or packaging rack. Similarly, in the present invention, the apparatus and method of the present invention must be capable of beginning with a supply of pipette tips randomly oriented in a container and automatically reorient, space and place them in the storage racks.

Figure 1:
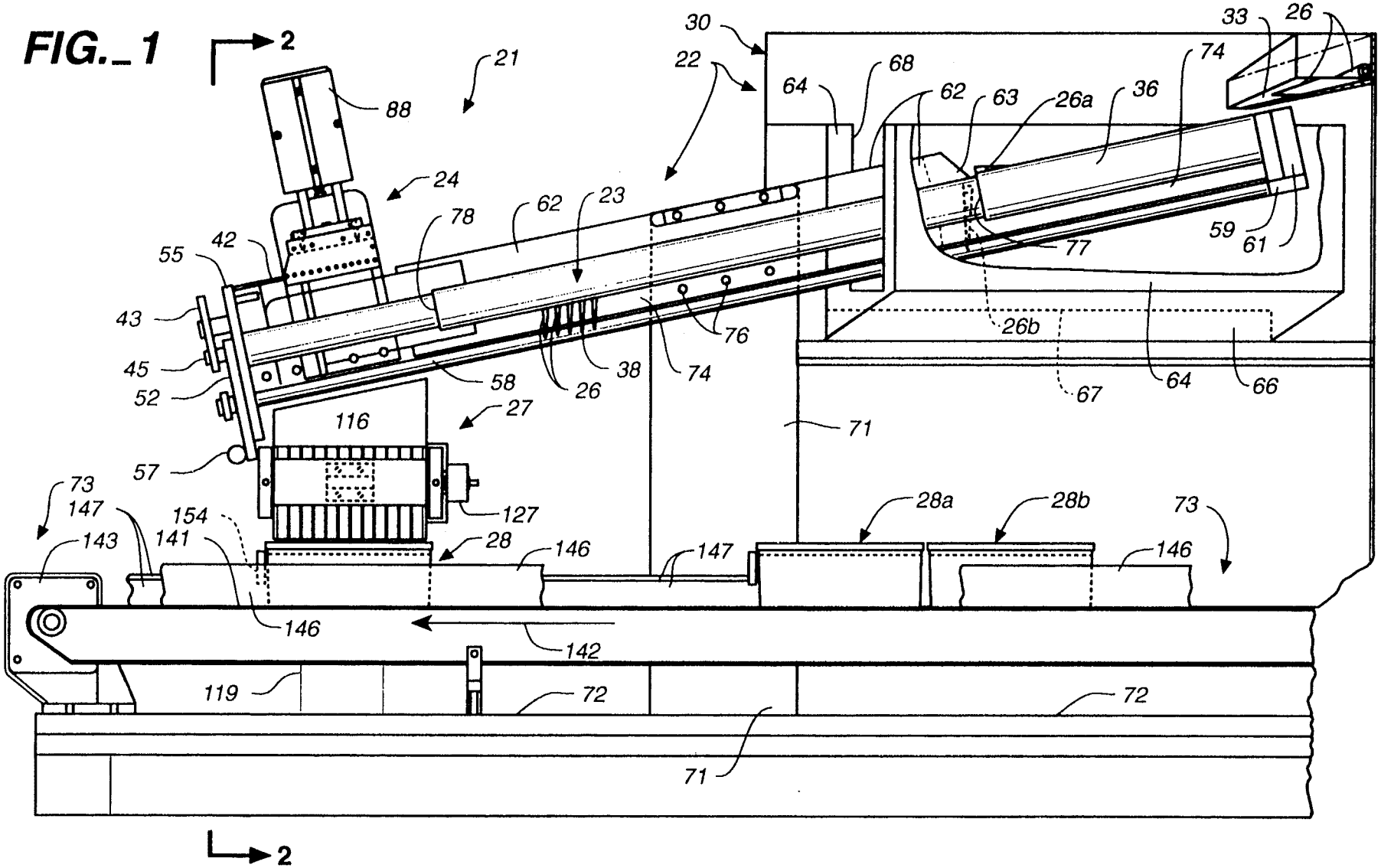
FIG. 1 is a front elevation view, partially broken away, of an apparatus constructed in accordance with the present invention for automated loading of pipette tips into a container.

Referring now to FIG. 1, an apparatus, generally designated 21, for automated loading of pipette tips into storage containers is shown which includes a tip-orienting assembly or means, generally designated 22, and a tip spacer assembly, generally designated 24. Tip-orienting means 22 includes a feeder 30 and a roller assembly or means 23, which together reorient pipette tips 26 from a random orientation to a common, side-by-side, substantially parallel and contacting orientation. Spacer assembly 24 spaces the tips for insertion into a container 28 and deposits the tips 26 either directly into container 28 or into a tip transfer assembly generally designated 27, which in turn is used to deposit the tips into pipette container 28.

In order to start the process of reorienting the tips from a random to a common orientation, it is preferable that tip-orienting assembly 22 include a vibratory feeder 30 of a type well known in the art. Feeder 30 and 30*a*in FIG. 9 can be cylindrical in form and have a spiral shelf or ledge 31 which extends upwardly from an outwardly tapered conical bottom 32 until the final land or spiral portion of the shelf discharges tips 26 in a generally horizontal orientation at a discharge outlet 33 on the upper surfaces of roller assemblies 23 and 23*a*. A 24 inch diameter model vibratory feeder suitable for use in the assembly of the present invention is manufactured by the Technavibes Company of Placerville, California.

Randomly oriented pipette tips 26 can be placed in feeder 23 through the open top and vibration will cause the tips to move down the conical surface 32 to peripheral shelf 31, where vibration will induce gradual spiral upward movement of the tips along shelf 31 to discharge outlet 33. During this vibration, the tips also will tend to become separated from each other and will become oriented so that they are laying on their sides or substantially horizontally, as shown in FIG. 1 at discharge 33. The orientation of the tips in a small end-forward or small-end rearward orientation, however, is random, and occasionally tips will remain nested during their migration up the spiral vibrating shelf.

Figure 2:
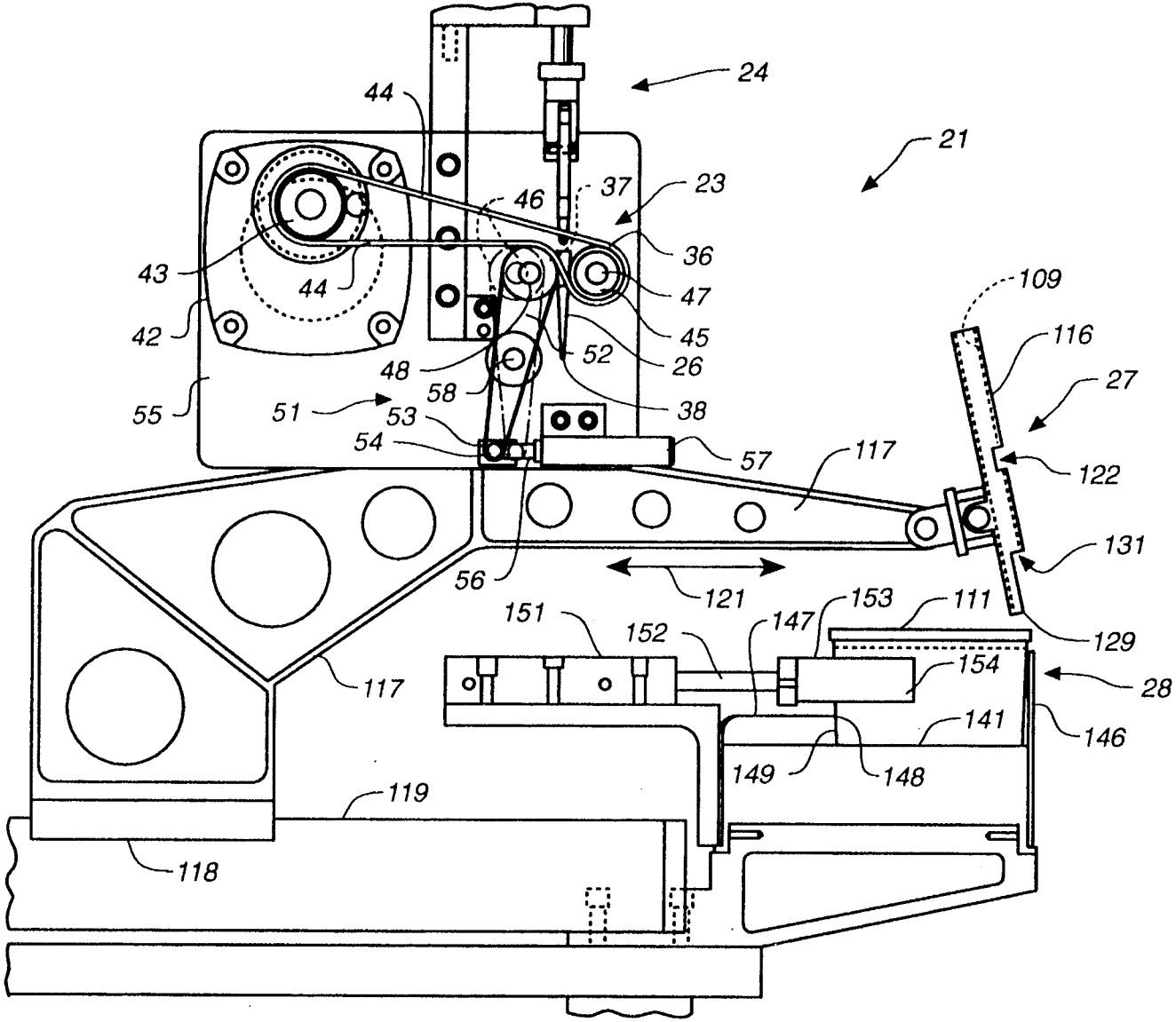
FIG. 2 is an enlarged, end elevation view of the apparatus of FIG. 1 taken substantially along the plane of line 2—2 in FIG. 1.
Figure 3:
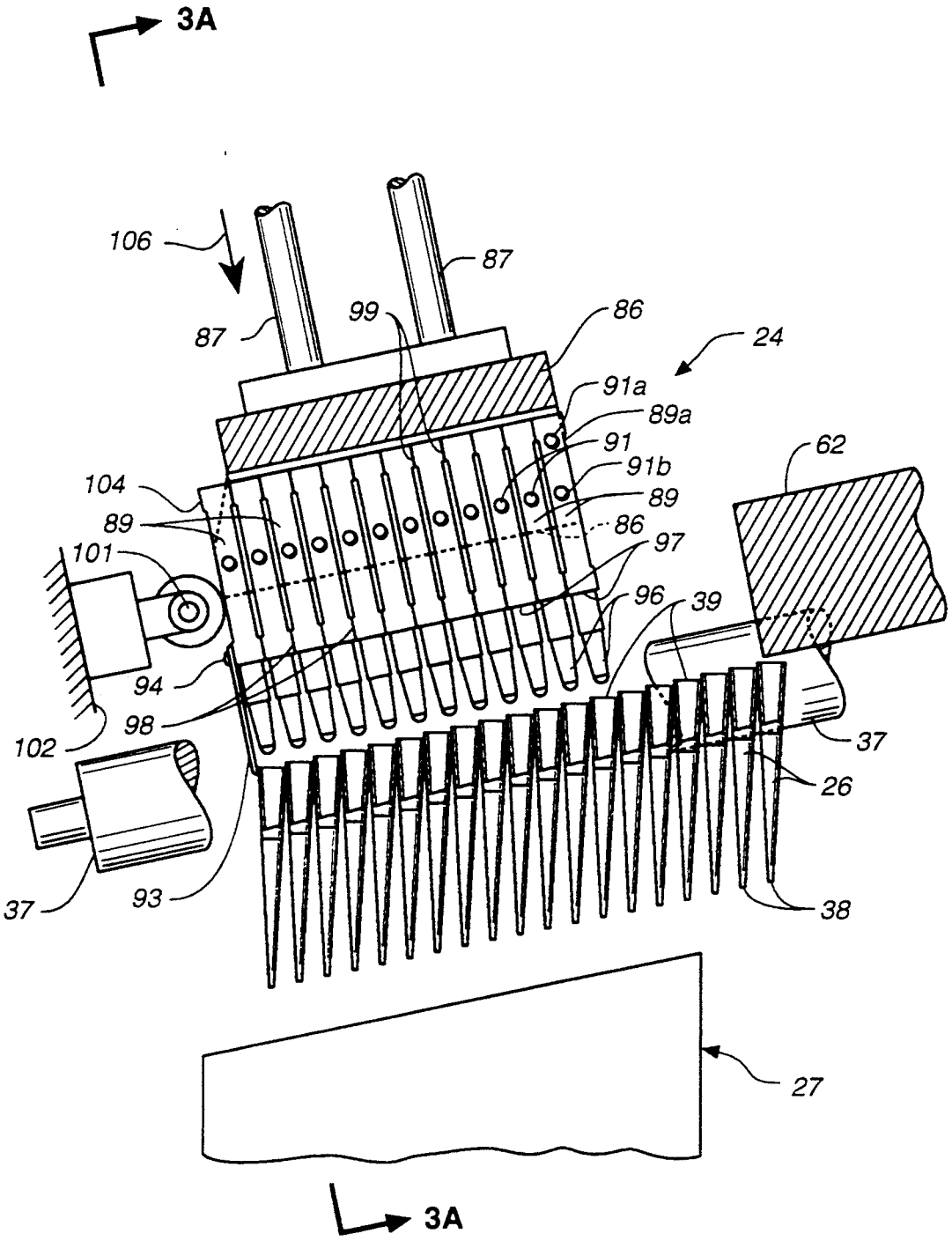
FIG. 3 is a further enlarged, fragmentary, side elevation view of the pipette tip spacer assembly of FIG. 1.
Figure 3A:
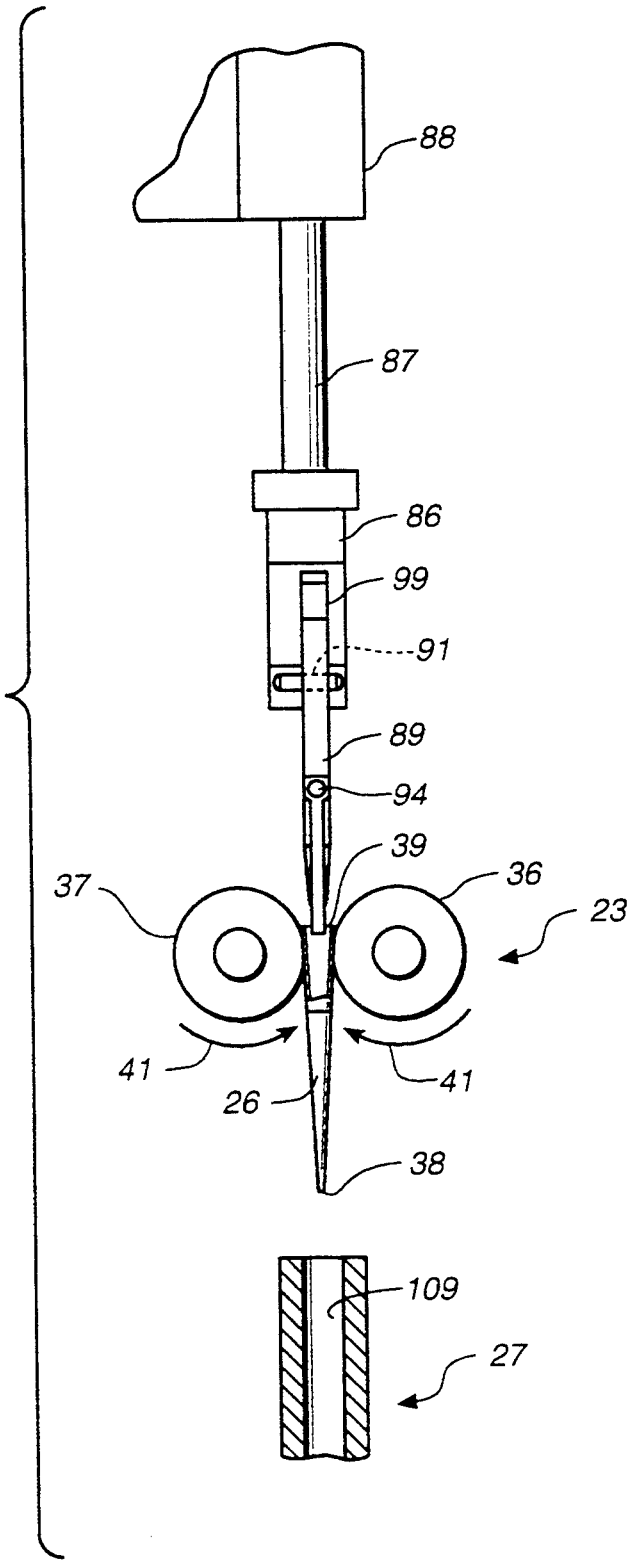
FIG. 3A is a fragmentary, end elevation view of the assembly of FIG. 3 taken substantially along the plane of line 3A—3A in FIG. 3.

In order to complete reorientation of the tips, a pair of tip-orienting, elongated rollers 36 and 37, best seen in FIGS. 2 and 3A are mounted in spaced apart relation by a distance greater than small diameter ends 38 and less than large diameter ends 39 of tips 26 to enable tips 26 to be supported between the rollers and oriented with the small end 38 of the tips suspended downwardly between the rollers. The spacing of rollers 36 and 37 is slightly less than large diameter ends 39 so that the tips cannot pass between rollers 36 and 37 merely under the influence of their own weight.

As will be appreciated, therefore, rollers 36 and 37 will tend to cause either forwardly or rearwardly oriented tips to assume a common, near vertical, substantially parallel orientation, with small ends 38 extending down between the rollers. In the preferred form, at least one, and most preferably both, of rollers 36 and 37 are rotating in order to assist in reorientation of the pipette tips to a common orientation. In fact, most preferably, the rollers 36 and 37 are counter-rotated, as indicated by arrows 41 in FIG. 3A, so as to tend to lift the tips up out of the space between rollers.

In order to produce side-by-side contact and spacing of the tips as determined by large diameter ends 39, it is further preferable that the rollers in roller assembly 23 be inclined to the horizon slightly. Thus, inclination of the longitudinal axes of rollers 36 and 37 combines with counter-rotation of the rollers to produce gravitation of the pipette tips from feeder discharge 33 to spacer assembly 24. The inclination of rollers 36 and 37 also should be sufficient to cause the tips to move into side-by-side contact so that the spacing of the tips is determined by large diameters 39 of the tips, as best may be seen in FIG. 3.

As can be seen in FIG. 2, counter-rotation of rollers 36 and 37 can be effected by a roller drive means or assembly including motor 42, drive sheave 43, flexible drive belt 44 and a pair of driven sheaves 45 and 46 fixed to axles 47 and 48, respectively, of rollers 36 and 37. It will be understood that various other roller drive assemblies are suitable for use to counter-rotate rollers 36 and 37.

In order to accommodate the automated loading of pipette tips 26 of various sizes, and in order to insure proper support of tips 26 while still allowing them to be pushed between the rollers, it is preferable that the apparatus of the present invention also include adjustment means, generally designated 51 (FIG. 2), formed for adjustment of the spacing between rollers 36 and 37. Most preferably, such adjustment can be accomplished while the rollers are rotating. As shown in FIG. 2, driven sheave 46, axal 48 and roller 37 are driven as a unit and are mounted to an upper end of adjustment arm 52. A lower end 53 of arm 52 carries a pin 54 that extends into an adjustment micrometer assembly having a U-shaped end 56. The manually grippable knob 57 of the micrometer assembly can be rotated to displace yoke end 56, with the yoke in turn displacing pin 54 and rotating adjustment arm 52 and a central shaft 58. The arm 52 is keyed to shaft 58, which is journaled for rotation to plate or member 55. Thus, the adjustment of micrometer 57 produces displacement of arm 52 about shaft 58 toward the dotted line position and at the same time rotates shaft 58 through a small angle.

In FIG. 1, shaft 58 will be seen to extend the length of the roller assembly and is journaled for rotation to end member 59 so as to rotate a second arm 61 at the opposite end of the roller assembly. The second arm carries the opposite end of axal 48 for roller 37 so that the full length of roller 37 can be swung through a small arc by micrometer 57 to adjust the spacing of rollers 36 and 37. The inherent flexibility and extensibility of the resilient belt 44 will enable adjustment of the spacing between rollers 36 and 37 while the rollers are being rotated. This enables the operator to make fine adjustments to insure that the pipette tips are supported in a manner allowing the same to be pushed between the rollers, as will be described in more detail below, while at the same time supporting the pipette tips in the common side-by-side orientation of FIG. 3 on the tip-orienting rollers.

Pipette tips 26 can be urged along roller assembly 23 from feeder discharge 33 to spacer assembly 24 using several techniques. The tips, for example, are relatively light in weight and can be moved by air jets along the rollers. Most preferably and as described briefly above, the rollers are inclined so as to cause gravitation of the tips, particularly in combination with rotation of the rollers. In the preferred form, the rollers are counter-rotated at a velocity of between about 300 rpm to about 600 rpm, and roller assembly 23 is inclined at an angle to the horizon of between about 10 degrees and about 15 degrees and most preferably 12 degrees. As the angle of inclination of rollers 36 and 37 increases, there is a tendency for adjacent tips to ride up on each other and be pushed upwardly out of the space between the rollers. This can be prevented by mounting a tip hold-down member 62 above and between rollers 36 and 37. Thus, the rollers can be inclined, for example, to about 12 degrees, and hold-down member 62 will keep the tips 26 from pushing up out of the space between the rollers as the tips gravitate toward spacer assembly 24.

Since some of the pipette tips discharged from feeder 30 will not fall down between the rollers in the desired fashion, it is preferable to further include a plow or deflector 63 mounted, for example, at the upper end of hold-down member 62, which deflector will knock horizontally oriented tips, such as pipette tip **26*a* in FIG. 1 off of the top of the rollers while vertically oriented pipette tip 26*b* will pass beneath deflector 63. This deflector can be assisted further by an air jet, not shown, which was particularly useful in blowing nested pipette tips from between rollers 36 and 37. Pipette tips which are deflected off of roller assembly 23 are caught by feeder return compartment or catch structure 64, which has a sloped bottom wall 66 causing pipette tips to gravitate toward an opening 67 in the sidewall of the feeder for return of improperly oriented tips to feeder 30. A slot 68 accommodates passage of the rollers from the interior of the return compartment outwardly thereof to the pipette tip spacer assembly 24**.

It is further preferable that rollers 36 and 37 be inwardly stepped in their diameters along the length of the rollers in a downwardly inclined direction. Thus, in an area proximate the deflector 63, an inward step 77 in roller diameter can be provided, and a second step 78 optionally can be provided proximate the spacer assembly 24. Roller steps 77 and 78 allow the pipette tips 26 to sink somewhat deeper into the space between the rollers, and since the pipette tips are to be pushed between the rollers at spacer assembly 24, the final roller spacing preferably is only a slight interference fit with the diameters of the pipette tips. The last step 78, however, is optional, while the first step has been found to cooperate with deflecting means 63 to insure deflection of improperly oriented pipette tips by allowing the properly oriented ones to sink lower than the depth of plow or deflector 63 between rollers 36 and 37. Thus, it will be seen that step 77 is slightly in advance of deflector 63 so that the properly oriented tips can sink down just as the improperly oriented ones encounter the deflector 63.

Mounting of roller assembly 23 at an incline can be accomplished by means of a bracket 71 mounted to support table 72, which also supports feeder 30 and a conveyor assembly, generally designated 73, and described in more detail hereinafter. Roller assembly 23 and spacer assembly 24 are both supported from a longitudinally extending frame member 74, which in turn is secured by fasteners 76 to mounting bracket or arm 71. This provides a cantilevered structure which eliminates the need for end support structures. Thus, feeder return 64 and nest assembly 27 can more easily be positioned under the opposite ends of roller assembly 23.

Figure 6:
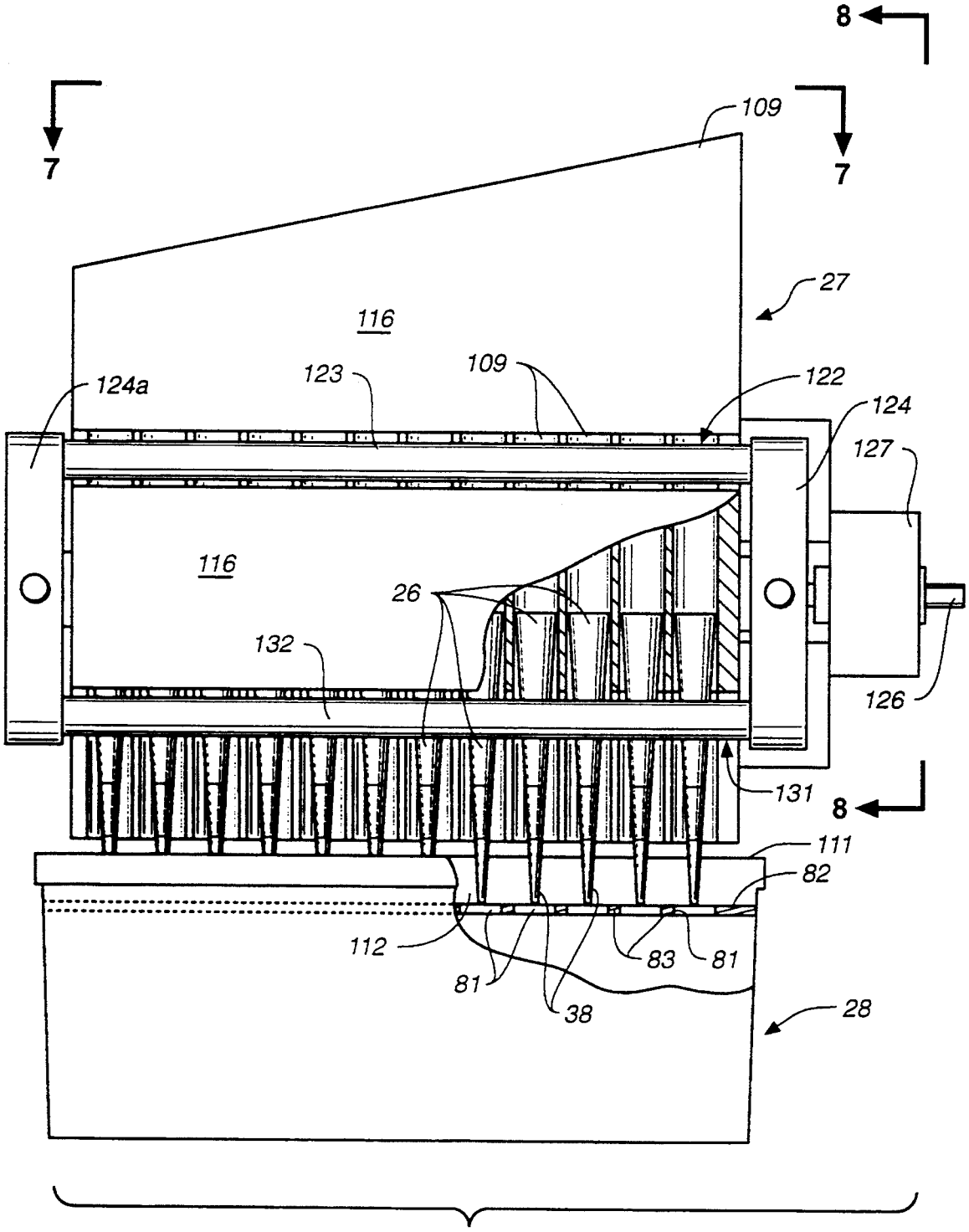
FIG. 6 is an enlarged, partially broken away, side elevation view of the nest assembly and container of FIG. 5 with the pipette tips in a moved position.

As best may be seen in FIG. 3, pipette tips 26 arrive at spacer assembly 24 in a near vertical orientation with each of the tips supported or suspended by their tip large diameter ends 39 at about the throat or minimum distance between rollers 36 and 37. While tips 26 are generally vertically oriented, the spacing between tips 26 is determined by the tip diameter since the tips are in side-by-side contact. As can be seen in FIG. 6, most storage racks or container assemblies 28 are formed with a plurality of openings 81 in a transversely extending member or sheet 82 in which the tip-receiving openings are spaced apart by some small distance 83.

Thus, the spacing of pipette tips 26 in FIG. 3 is not well suited for direct mounting of the tips in pipette tip rack 28. Pipette tip spacer assembly 24, therefore, is used to perform two functions. First, the tips are spaced by assembly 24, and second, they are transferred to one of container 28 or transfer assembly 27, preferably by pushing the tips through the rollers. In the preferred form, tips 26 are pushed by spacer assembly 24 through roller assembly 23 and into a nest-like transfer assembly 27 for transfer of the tips into rack 28.

It will be apparent, however, that spacer assembly 24 also could be used merely to push tips 26 through the tip orienting rollers and directly into rack 28 if the rack had a spacing of the tip-receiving openings 81 which enabled use of the spacing of tips 26 on the rollers. In a usual situation, however, tips 26 must be separated slightly from side-by-side contact in order to align them with, or space them in a manner corresponding to the spacing of openings 81 in rack 28.

Spacer assembly 24 preferably includes a pusher member 86 mounted, for example, on pistons 87 of a pneumatic actuator or cylinder 88. Carried by pusher member 86 are a plurality of spacer elements 89, which are each pivotally mounted (with one exception) to pusher member 86 at pivot pins 91. In the embodiment shown in FIG. 3, the end pusher element **89*a* is mounted to pusher member 86 by two pins 91*a* and 91*b* so that the orientation of member 89*a* is fixed relative to pusher member 86**.

In order to locate pipette tips 26 for spacing, spacer assembly 24 also can include a stop member 93 mounted by a fastener 94 to pusher element 89 at the lower end of the assembly. Stop member 93 can be seen in FIG. 3A to extend down between rollers 36 and 37 by a distance sufficient to engage the end-most pipette tip 26 to thereby prevent further advancement of the pipette tips along rollers 36 and 37. Thus, when the end pipette tip engages stop 93, the row of pipette tips will be indexed or aligned with tapered ends 96 of spacer elements 89. Ends 96 of the spacer elements are tapered and have a dimension sufficiently small to be slidably inserted inside open upper or large diameter ends 39 of the pipette tips. The ends of the spacer elements can also be seen to be formed with a downwardly facing annular shoulder 97, which has a dimension sufficient to interengage with the upwardly facing end of the pipette tips. These ends 96 also are of sufficient length to control tip 26 during angular displacement.

A tip stop 93 which is mounted to the downstream-most pusher element 89 will enable any number of pusher elements to be in assembly 24 so that packages or racks with a smaller or different number of tips per row can be easily loaded using the present invention.

Moreover and very importantly, each spacer element 89 is formed with a width dimension at lower spacing lands 98 which results in the tapered ends of the spacer elements having the same spacing as the side-by-side pipette tips when they are in contact with each other on roller assembly 23. Pusher elements 89 also are formed with upper spacing lands 99 which control or limit the amount of pivoting of the pusher elements about pivot pins 91.

As will be seen from FIG. 3, an alignment means for movement or pivoting of spacer elements 89 is provided in the form of a roller element 101 mounted to a frame support 102, which rolls along end surface 104 of the end-most spacer element 89.

Figure 4:
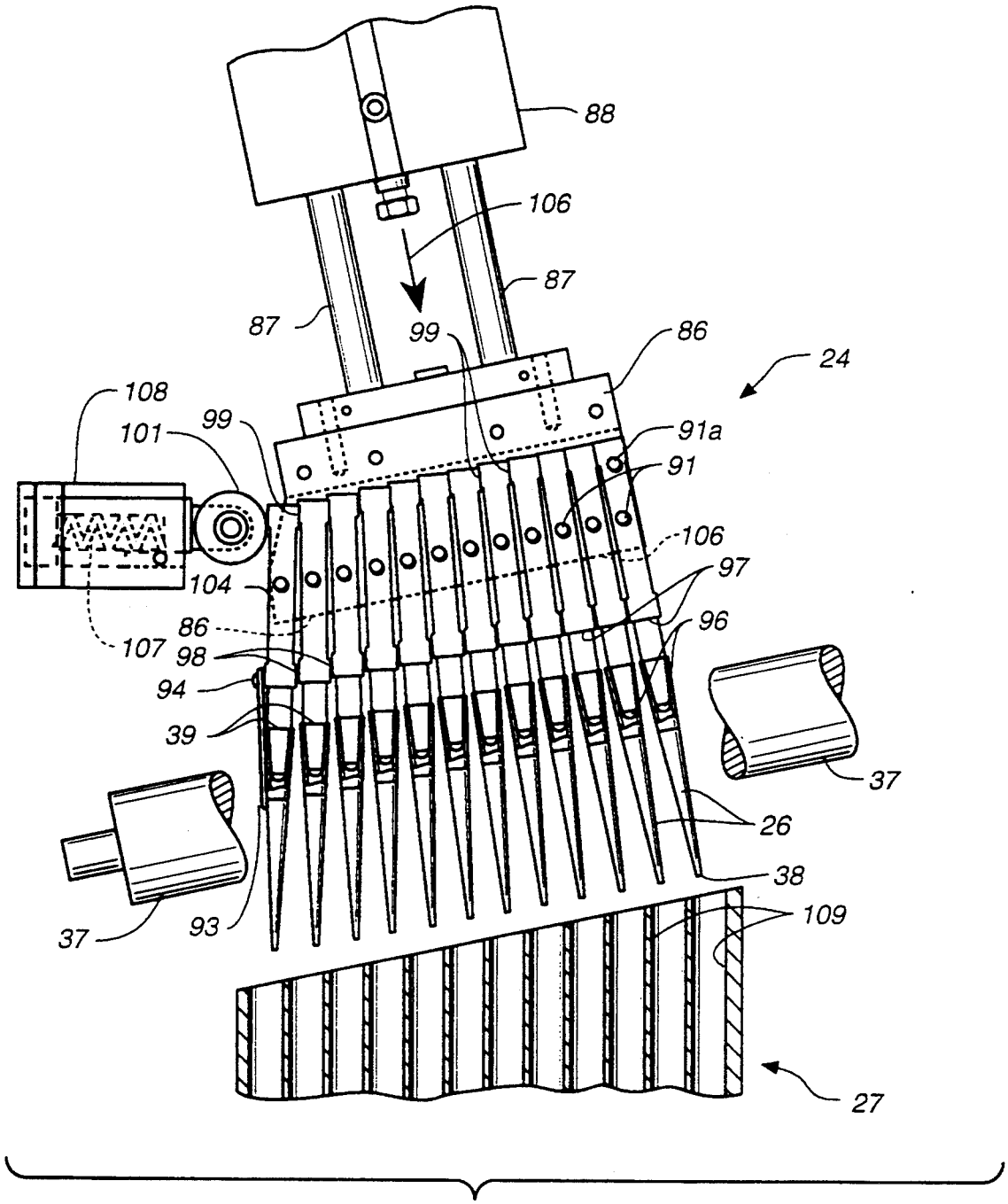
FIG. 4 is a further enlarged, side elevation view of the assembly of FIG. 3 with the tip spacer assembly in a downwardly moved position from FIG. 3.
Figure 5:
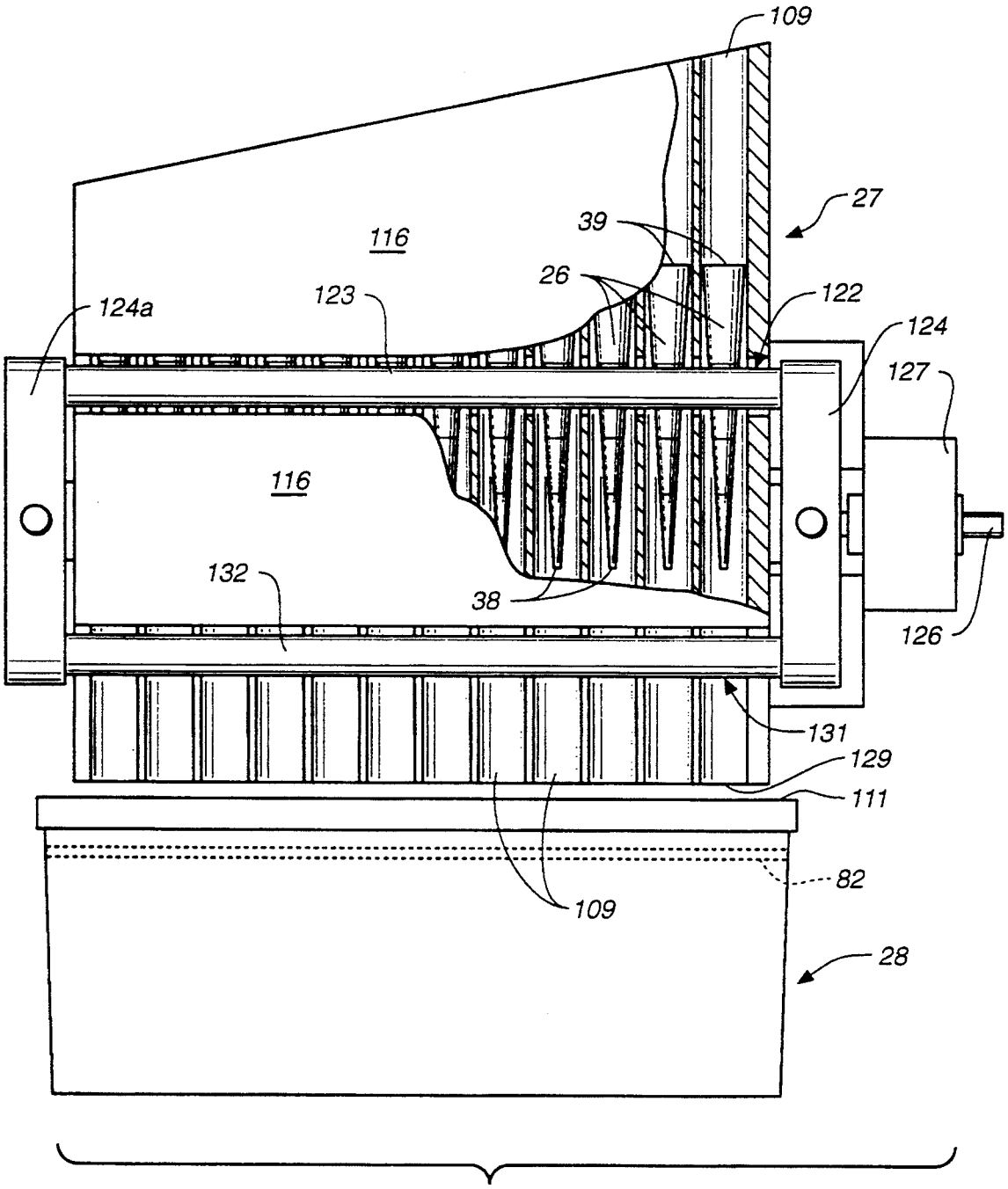
FIG. 5 is an enlarged, partially broken away, side elevation view of the nest assembly and container of FIG. 1.

Comparison of FIGS. 3 and 4 will indicate the manner of movement of the spacer assembly 24 from a position out of engagement with the pipette tips to a position in interengagement with the pipette tips, and finally, to a position in which the tips are spaced apart and aligned with the tip-receiving nest assembly 27. As will be seen in FIG. 3, roller 101 bears upon surface 104 on spacer 89 at a position below pivot pins 91, which pivots all of pins 89 counterclockwise until contact of lower spacing lands 98, as shown in FIG. 3. Each of lower spacing lands 98 contacts the adjacent land. The dimensions of lower spacing lands 98 is such that the ends 96 of the pusher elements are aligned with the open ends 39 of the pipette tips.

Next, actuator 88 for the spacer assembly extends pistons 87 and pusher member 86 in a downward direction, as indicated by arrow 106. This causes roller 101 to roll along spacer element end surface 104 past pins 91. A spring biasing means 107 (FIG. 4) urges the roller assembly outwardly of housing 108 so that the roller follows surface 104. As roller 101 passes pins 91, spacer elements 89 all pivot to the position shown in FIG. 4.

The amount of pivoting of each spacer element 89 is controlled by upper lands 99, which are formed to provide a slight space between the respective upper lands so as to permit pivoting about pins 91. The amount of these spaces is sufficiently small that the drawing does not permit clear illustration of the same. Nevertheless, the upper lands 99 on the upper ends of pusher elements 89 are dimensioned so that when the assembly is pushed downwardly, each pusher element will be angularly rotated or displaced about pins 91 by an amount sufficient to align the ends 96 of the pusher elements, and accordingly, small diameter end 38 of pipette tips mounted thereon, in alignment with one of openings 81 in storage rack 28 or one of bores 109 in a transfer nest assembly 27.

The length of ends 96 of spacer elements 89 is such that movement of the assembly downwardly past pins 91 allows translation or clockwise pivoting before contact of annular shoulder 96 with ends 39 of tips 26. The length of ends 96 also insures that the tips will pivot or stay aligned with spacer elements 89. Angular pivoting also reduces the amount of movement necessary to produce tip alignment.

Moreover, and very importantly, the length of travel or extension along direction 106 before the spacer elements 89 begin to pivot is such that the noses or tapered ends 96 of each of the pusher elements will enter and become interengaged with the wall defining open ends 39 of the pipette tips. Once ends 96 are engaged with ends 39 of the pipette tips, continued movement of the assembly 24 in the direction of arrow 106 begins to produce pivoting of the spacer elements to the position of FIG. 4. Advancement of pusher member 86 preferably continues in the direction of arrow 106 until the shoulders 97 engage the upper ends of the tips and then just before the pipette tips are pushed between rollers 36 and 37, the spacer elements are pivoted to the position of FIG. 4.

It should be noted that, while shoulder 97 is sufficiently outwardly stepped in a direction along the rollers to engage and enable pushing of the pipette tips between the rollers, as viewed in FIG. 3A, shoulders 97 have a width dimension which is less than the diameter of upper end 39 of tips 26 so that the resilient plastic tips may be deformed or urged inwardly as the spacer elements push the tips downwardly through the throat between rollers 36 and 37. By the time the tips are pushed past the narrowest point between the two rollers, the ends 38 are all aligned with the respective bores 109 in nest 27 or openings 81 in container 28 so that the tips can gravitate or fall away from ends 96 of the spacer elements and into the bores or openings. To permit such gravitation away from the spacer elements, each of the tapered ends 96 is sufficiently smaller than the inside bore diameter of tips 106 so as to freely release the tips for gravitation once the large diameter ends have been pushed between or beyond the rollers.

In summary, therefore, stop means 93 stops the tips in aligned registration with the spacer elements which are collapsed when the entire assembly is retracted. The spacer elements are then advanced toward and inserted into the interior of the tips, and the spacer elements further are pivoted as they are advanced to space or align tips 26 with either a storage rack or a nest for transfer to a storage rack. The shoulders on the spacer elements allow the tips to be pushed past the rollers without becoming wedged thereon, while the tips are aligned with the bores or openings, and the tips thereafter gravitate into the storage rack or into a nest for transfer to a storage rack. Assembly 24 can then be retracted to allow the up-stream pipette tips on rollers 36 and 37 to gravitate or move down to stop 93 for alignment of another row of tips with the spacer element assembly.

As shown in the drawing, twelve tips are engaged at a time by the ends of the spacer elements 89 and then are pivoted into a predetermined spaced relation for transfer to the nest or storage rack. The inherent resiliency of the disposable plastic pipette tips is employed to allow urging of the tips beyond the support rollers which were used to orient the tips in a near vertical orientation.

While alignment assembly 24 can be used to directly deposit pipette tips into storage rack or container 28, it is preferable to employ an intermediate transfer assembly 27, which enhances the reliability of placement of the tips in their respective tip-receiving openings 81 of container 28. Pipette tips 26 are relatively light in weight, and accordingly, placement of the tips into container openings 81 is significantly influenced by slight misalignments, tip vibration and even aerodynamics. It is relatively easy to lose control of the orientation and alignment of the tips, making dropping them from, even a modest height above openings 81 somewhat unpredictable in terms of the reliability of loading the tips in container or rack openings.

In the present invention, therefore, it is preferable to provide a nest assembly 27 which can be used to control the alignment of tips 26 until they are very closely adjacent to the tops of the container openings 81 and can be safely and reliably released for gravitation down into container 28. As will be seen in FIG. 6, pipette tip racks 28 very often are formed with a transverse tip receiving and supporting member 82 which is recessed from the upper edge 111 of the container side walls. Thus, there is circumferentially extending wall portion 112 above the tip-receiving member 82 which would act as a standoff distance over which the tips must be dropped if they are released from a height above top edge 111 of rack 28. Nest assembly 27, however, allows the tips to be released when aligned with the proper row of openings 81 from the position shown in FIG. 6 in which small diameter ends 38 of the tips are immediately proximate and above openings 81. Release of the tips from the position shown in FIG. 6, therefore, allows the nest to positively control the orientation and spacing of the tips until they are immediately adjacent to the openings so that release of the tips will reliably result in the tips falling down into their proper rack opening 81.

The structure of nest assembly and its operation can best ill be understood by reference to FIGS. 5–8. A plurality of side-by-side bores 109 are provided in nest member 116 at a spacing which preferably matches the spacing of openings 81 in pipette tip rack 28. The number of bores preferably corresponds to the number of pipette tips pushed between rollers 36 and 37 by spacer assembly 24 in a singe stroke and most preferably is equal to the number of openings 81 in each row of openings in tip rack 28. Thus, both spacer assembly 24 and nest 27 are preferably set up to place one complete row of tips 26 in rack 28 for each cycle.

One of the additional important functions of nest assembly 27 is to enable loading of adjacent, side-by-side rows of openings 81. In a typical rack, there will be eight side-by-side rows of twelve tips, 20 rows of ten tips or ten rows of ten tips. Thus, if tips were to be loaded directly into container 28 from the orientation rollers 36 and 37, one would have to move either the roller assembly or to move the container to accommodate placement of the tips in the side-by-side rows of openings. The nest transfer assembly 27 can be used, therefore, to allow roller assembly 23 and rack 28 to be stationary, with nest transfer assembly 27 being movable so as to enable transfer between the roller assembly and selected side-by-side rows of openings in container 28.

FIG. 2 illustrates the relative transverse positioning of container 28 and roller assembly 23. As shown in FIG. 2, movable nest 27 is mounted to a gantry arm 117 that, in turn, is mounted to a movable carriage 118 slidably coupled to track 119 and powered by a gantry actuator (not shown). The gantry actuator provides linear reciprocal movement of the gantry and nest as indicated by arrows 121. Linear actuators suitable for programmed displacement of a carriage and arm or gantry between a position for nest 27 to receive pipette tips from roller assembly 23 to positions above each row of openings in rack 28 are well known and commercially available programmable actuators. A typical actuator suitable for this purpose is the Intelligent Actuator, Model EX.

Nest assembly 27 shown in FIGS. 1–8 is formed with bores 109 having an internal diameter permitting free sliding movement or gravitation of tips 26 down the length of the bores. However, in order to stabilize and control the tips for release from a position immediately adjacent to openings 81 in rack 28, nest assembly 27 also has a tip retention means. FIGS. 2 and 5–8 illustrate that nest body 27 is formed with a notch 122 which extends transversely across all of bores 109 and which receives a retention bar 123 therein. Retention bar 123 is carried by a T-shaped member 124 which, in turn, is keyed to shaft 126 driven by a motor 127 or other actuator. Motor 127 rocks the T-shaped member 124 so as to selectively position retention bar 123 in notch 122 across bores 109. When bar 123 is seated against adjustable stop 128, bar 123 prevents the pipette tips from gravitating past bar 123 down bores 109. As will be see in FIG. 5, therefore, tips 26 are held in a retracted position in nest body 116 so that their lower ends 38 are above the lowermost edge 129 of nest member 116. In this position, gantry arm 117 can be advanced across the top of rack 28 so that the lower edge 129 of nest member 116 will just clear the upper edge 111 of rack 28. This allows the nest to be brought into very close proximity, and yet still clear, the top of the pipette rack. Once the nest is in proper alignment with the row of holes into which tips 26 are to be loaded, motor 27 can rock T-member 124 in the reverse direction to a position allowing tips 26 to gravitate or drop down past bar 123 toward rack 28. In the nest assembly of the present invention, a second notch 131 is provided and a second retention bar 132 extends across bores 109 so as to engage and prevent further dropping of tips 26. As best may be seen in FIG. 2, the second notch extends to the lower edge and effectively opens the lower portion of bores 109 from notch 131 to edge 129.

FIG. 6 illustrates the tips as retained by bar 132 in a position with lower ends 38 below the upper edge 111 of rack 28 and immediately above openings 81 in the transverse opening defining member 82. This second retention bar allows the tips to come to rest and be stabilized in an extended position by bar 132 prior to release of the tips into openings 81. If the tips are dropped, for example, from bar 123 directly into openings 81, they will tend to flutter, vibrate and become misaligned with the openings during gravitation down bores 109. Thus, second retention bar 132 allows the tips to be stabilized and controlled when they are sufficiently close to openings 81 that their subsequent release will reliably result in gravity loading of the tips into openings 81.

Figure 7:
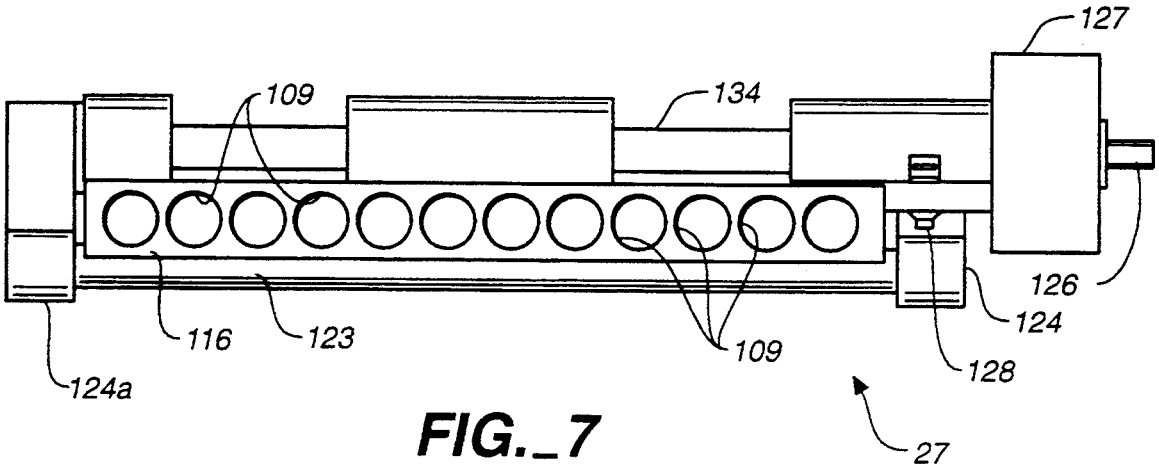
FIG. 7 is a top plan view of the nest assembly taken substantially along the plane of line 7—7 in FIG. 6.
Figure 8:
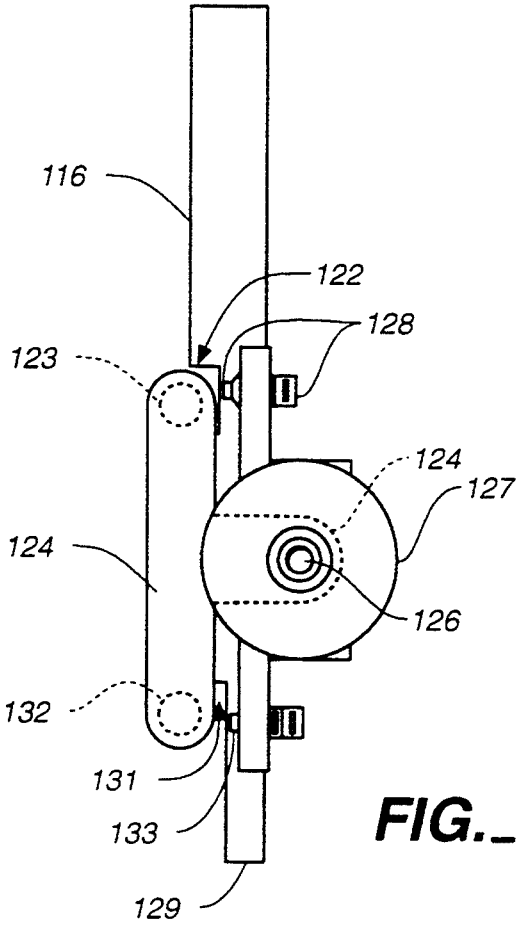
FIG. 8 is an end elevation view of the nest assembly taken substantially along the plane of line 8—8 in FIG. 6.

The depth at which retention bar 132 enters notch 131 can be controlled by adjustable stop means 133, and as will be seen best in FIGS. 7 and 8, nest assembly 27 most preferably includes a T-shaped second bar **124*a* at an opposite end of bars 123 and 132, which is driven by a common extension shaft 134 of drive shaft 126. Thus, both members 124 and 124*a* are keyed to shaft 126 and can be rocked by motor 127 so as to first retain tips 26 in the retracted position of FIG. 5 by rocking bar 123 inwardly, release tips 126 to gravitate to the extended position of FIG. 6. Rocking bar 123 out of notch 122 will be seen to simultaneously rock bar 132 into notch 131, and release of tips 126 into the storage rack 28 can be accomplished by rocking retention bar 132 out of notch 131 and simultaneously rocking retention bar 123 into notch 122** to receive the next row of tips.

As further may be seen in FIG. 2, it is preferable that nest 27 be slightly inclined, for example, at about 6 degrees with respect to a vertical plane in a direction inclined away from the open side of notch 131. This slight inclination further insures that tips 26 will gravitate reliably into openings 81 in rack 28.

Loading of pipette tips into racks 28 requires that the racks be positioned repeatably in an indexed relation to the gantry assembly as the gantry is moved between tip-orienting roller assembly 23 and the various positions for release of tips from nest assembly 27 into the pipette tip rack. As best may be seen from FIGS. 1 and 2, it is preferable that the automated pipette tip loading apparatus further include a conveyor assembly 73 having a belt 141, which can be driven in either direction, but here is shown being driven in the direction of arrow 142 by conveyor motor 143. Mounted proximate and above the upper stretch of belt 141 are two guide or positioning flanges 146 and 147. Flange 146 is provided as a vertically extending wall that extends over the length of conveyor belt 141, as best seen in FIG. 2. Flange 147 is provided by an inverted L-shaped flange which extends inwardly over belt 141 to a position at which its inner end 148 engages the inner side 149 of rack 28. The guide flanges 147 and 146, however, allow racks 28 to slide therebetween.

Also provided at the loading station for loading of the pipette tips into the racks is a longitudinal positioning assembly which includes an actuator 151 having an extensible piston 152 which carries an L-shaped positioning member 153. The arm 154 of positioning member 153 determines the longitudinal position of the rack by engaging a front surface thereof and preventing further advancement of the rack with the conveyor. The continuing operation of belt 141 in direction 142 insures that the rack is constantly urged against arm 154 to maintain the rack in indexed position for loading of tips. Once the rack is filled, actuator 151 retracts arm 154 from in front of the rack so that the rack can proceed in a forward direction as carried by belt 141. It is preferable that in the extended position member 153 does not clamp the rack against flange 154, but instead, stops short of clamping to effect lateral indexing of rack 28 between member 153 and wall or flange 146.

Upstream of the rack which is being loaded by nest transfer assembly 27 are additional empty pipette racks **28*a* and 28*b*. These additional racks can be held against advancement by a retention member 156, which can be selectively released to allow one rack at a time to advance to the loading station. One method of retaining and releasing racks is to provide a rocker arm assembly (not shown) which operates by clamping the most advanced rack 28*a* against opposed wall 146 and then releases rack 28*a* by rocking in an opposite direction and clamping rack 28*b* against wall 126 as rack 28*a* escapes and advances to the loading station. Once 28*a* is positioned for receipt of tips from nest 27, the rocker arm retention device then rocks in the opposite direction to allow rack 28*b* to move forward for clamping in the more advanced position against wall 146. As will be apparent, other forms of rack release assemblies can be employed in combination with conveyor assembly 73** in the apparatus of the present invention.

OPERATION

Operation of automated pipette loading apparatus 21 now can be described. Randomly oriented, disposable, hollow tubular, plastic pipette tips are placed in the open upper end of vibratory feeder 30 and allowed to vibrate up the spiral feeder ramp 31 for discharge onto roller assembly 23 at discharge outlet 33. A plurality of pipette racks 28 are placed on conveyor 73 and cycled until one rack 28 is positioned at a loading station under nest assembly 27.

The near-horizontal oriented tips 26 fall from feeder discharge 33 onto the upper surfaces between rollers 36 and 37, which are counter-rotated so as to assist in orienting the tips in a near vertical orientation in the gap between rollers. Improperly oriented tips are deflected off the top of the rollers by deflector 26 and returned through containment or catch enclosure 64 and opening 67 to feeder 22. The properly vertically oriented tips gravitate down roller assembly 23 to a position under spacer assembly 24, which is in the retracted position shown in FIG. 3. The spacer assembly is then advanced transversely of and toward the rollers until small diameter ends 96 of spacer elements 89 are inserted into open upper ends 39 of the pipette tips. As the pusher elements are inserted into the ends of the pipette tips, the pusher elements gradually swing from the position of FIG. 3 to the position of FIG. 4, under the influence of alignment surface 103 as it passes from below to above pivot pins 91. The result is that the spacer elements are angularly displaced until ends 38 of the pipette tips are in line with bores 109 in nest assembly 27. At the same time, actuator 88 continues to advance the spacer elements 89 transversely of rollers 36 and 37 until the pipette tips are pushed between the narrowest gap between the opposed rollers. This is accomplished by inward flexing of the tip large diameter ends to permit passage beyond the rollers.

Once the pipette tips are past the rollers, ends 38 will be in very close proximity to bores 109 in nest 27 and the tips are free to gravitate off of ends 96 of the spacer elements. Tips 26 then slide down bores 109 until they are retained by retention bar 123 in the position shown in FIG. 5. At this point, transfer gantry 107 is moved outwardly along track 119 until nest member 116 is over a row of openings 81 in pipette rack 28 for loading of the tips into the rack. Usually the farthest position is loaded first and the gantry actuator is programmed to move to the farthest position for deposit of the first row of tips. T-member 124 is then rocked so as to release tips 126 from bar retention bar 123 so that the tips can drop down to the extended position of FIG. 5 for stabilization immediately above the member 82 defining pipette tip receiving openings 81. Once stabilized, the T-bar is again rocked or rotated in the opposite direction to release the tips for gravitation into the rack. Gantry 117 is then reciprocated back underneath rollers 36 and 37 to receive the next row of tips. During the outward reciprocation of the gantry, the alignment and spacer assembly is moved to an upward position allowing the next row of tips on rollers 36 and 37 to gravitate along the rollers until they reach stop member 93 and are indexed to receive the spacer elements.

Using the apparatus of FIGS. 1–8 a row of pipette tips can be loaded into rack 28 in 2 seconds, so that a rack having eight side-by-side rows of twelve tips can be completely filled in only 16 seconds. Including cycling of subsequent racks **28*a*, 28*b*, etc., the apparatus of FIGS. 1 through 8** automatically can load approximately 17280 pipette tips into pipette racks in one hour.

ALTERNATIVE EMBODIMENT

FIGS. 9 through 12A illustrate an alternative embodiment **21*a* of the automated pipette tip loading apparatus of the present invention. In apparatus 21*a*, an alternative tip spacer assembly 24*a* is provided, as is an alternative nest assembly 27*a*, which is used with a robot arm transfer device, generally designated 200, to transfer tips from roller assembly 23*a* to the pipette tip rack 28**.

Feeder 30A can be constructed and operate in the same manner as described in connection with feeder 30. Moreover, the feeder deposits pipette tips onto inclined rollers 36 and 37 for orientation of the tips in a generally vertical alignment and gravitation of the same along the inclined, counter-rotating rollers to the spacer assembly **24*a*. Thus, the tips arrive at spacer assembly 24*a* in the orientation shown in FIG. 10, with lower ends 38 depending downwardly between rollers 36 and 37 and open upper ends 39 supporting the tips between rollers 36 and 37. The advance of pipette tips 26 along roller assembly 23*a* is limited by stop member 93 so as to index the tips in side-by-side contact for insertion of the tapered ends 96 of pusher elements 89** into the tips.

Figure 10:
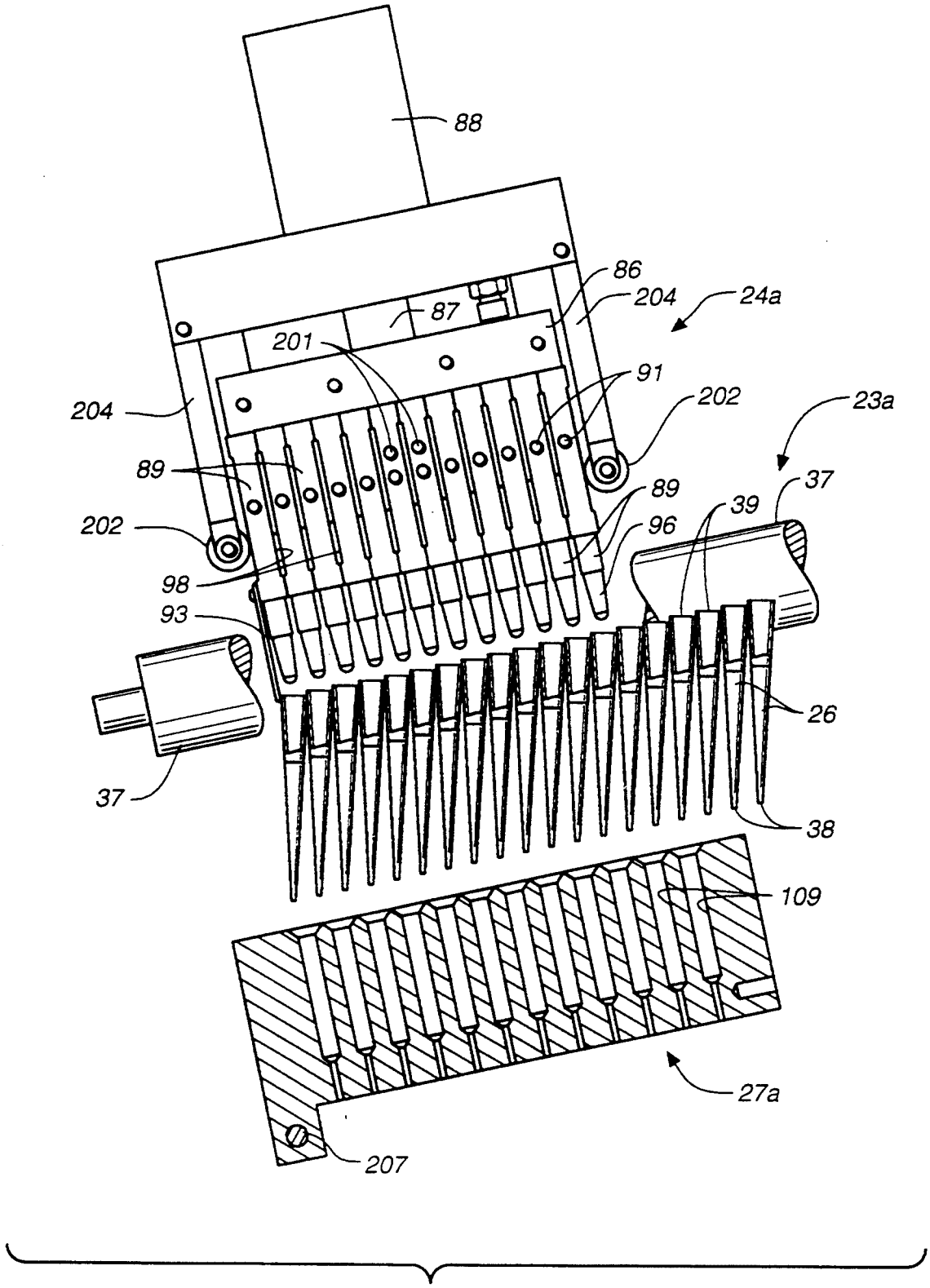
FIG. 10 is an enlarged, side elevation view corresponding to FIG. 3 of the tip spacer assembly of the alternative embodiment of FIG. 9.
Figure 11:
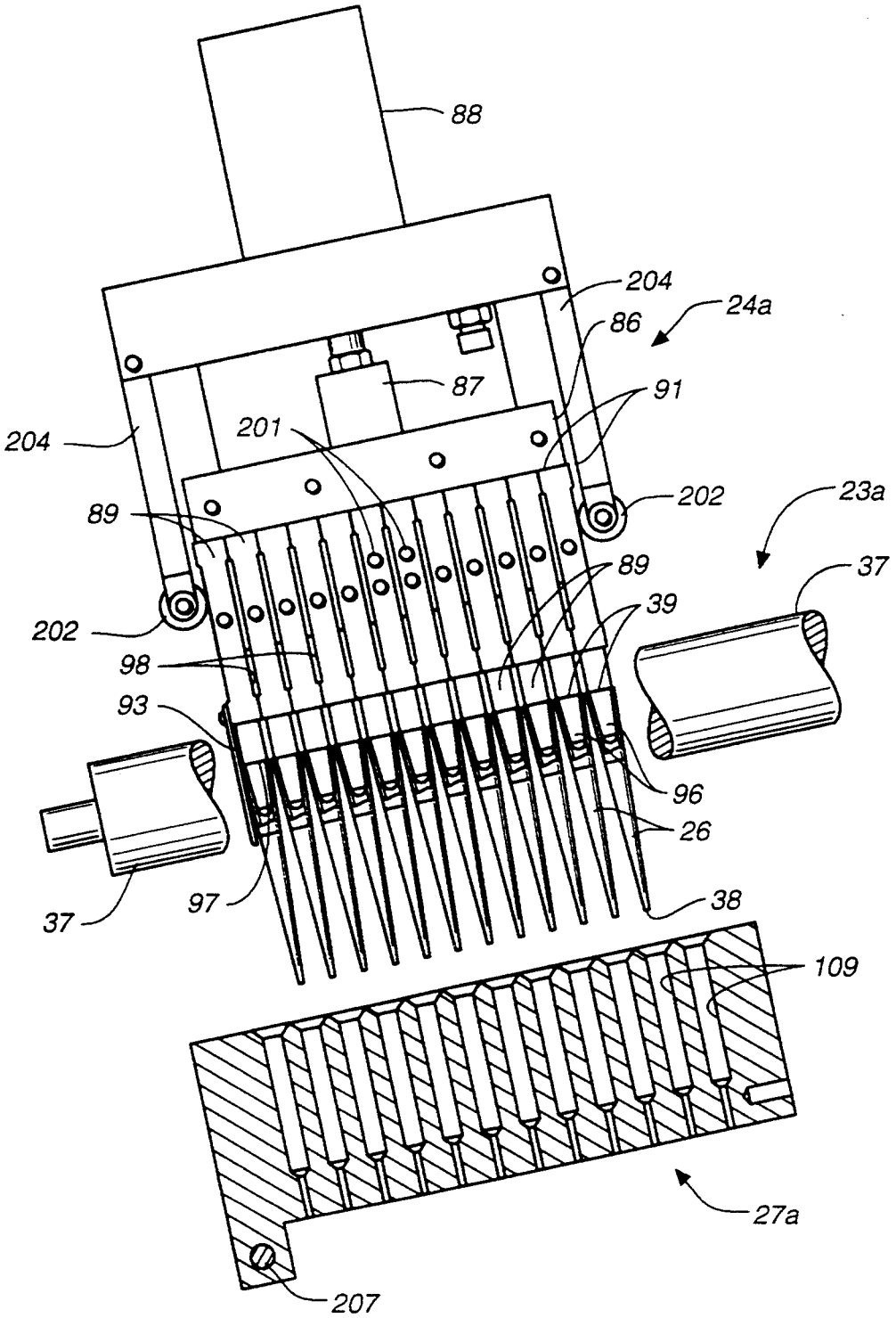
FIG. 11 is an enlarged, side elevation view of the spacer assembly of FIG. 10 in a downwardly moved position.
Figure 12:
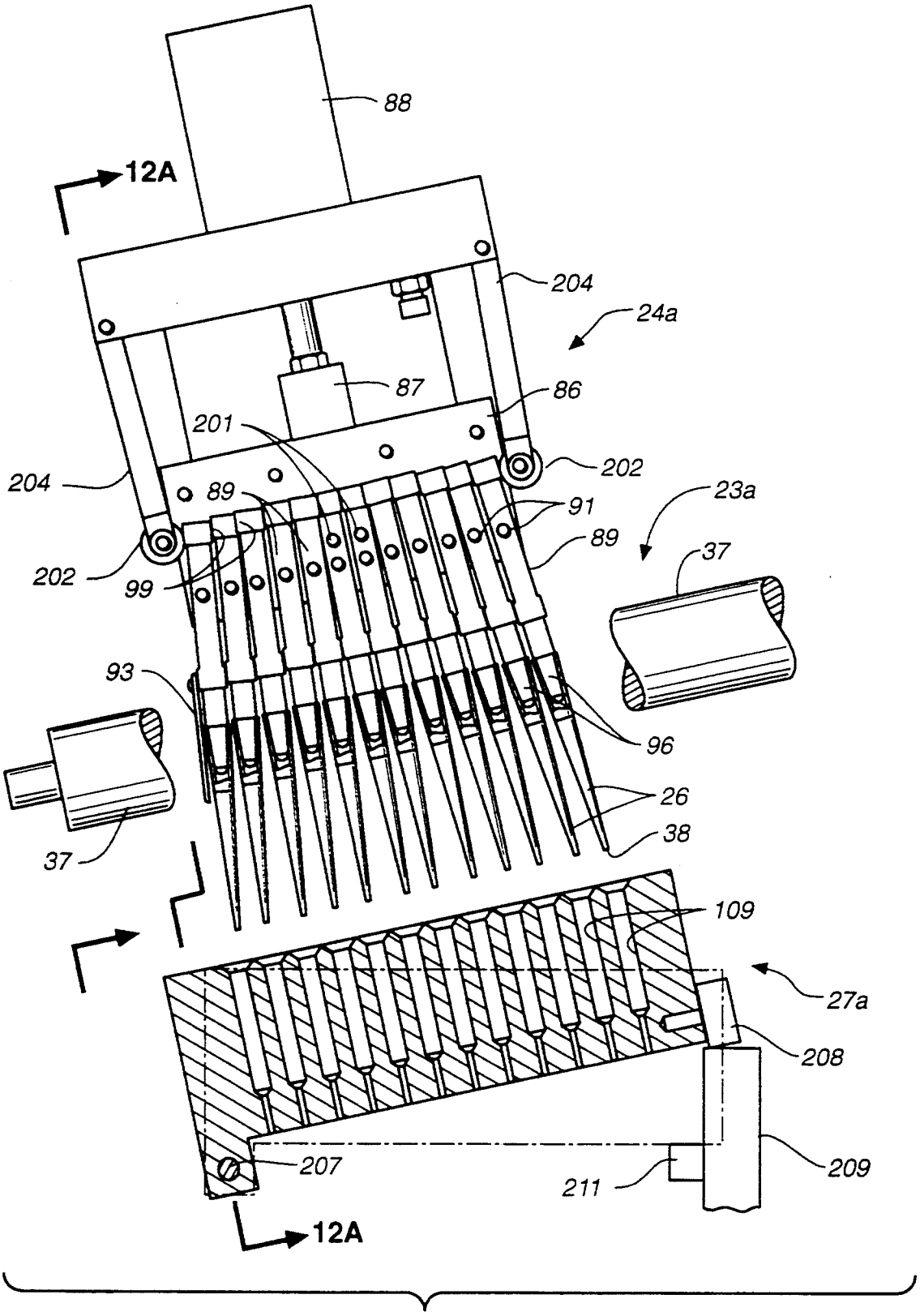
FIG. 12 is another enlarged, side elevation view of the spacer assembly of FIG. 10 in a further downwardly moved position.
Figure 12A:
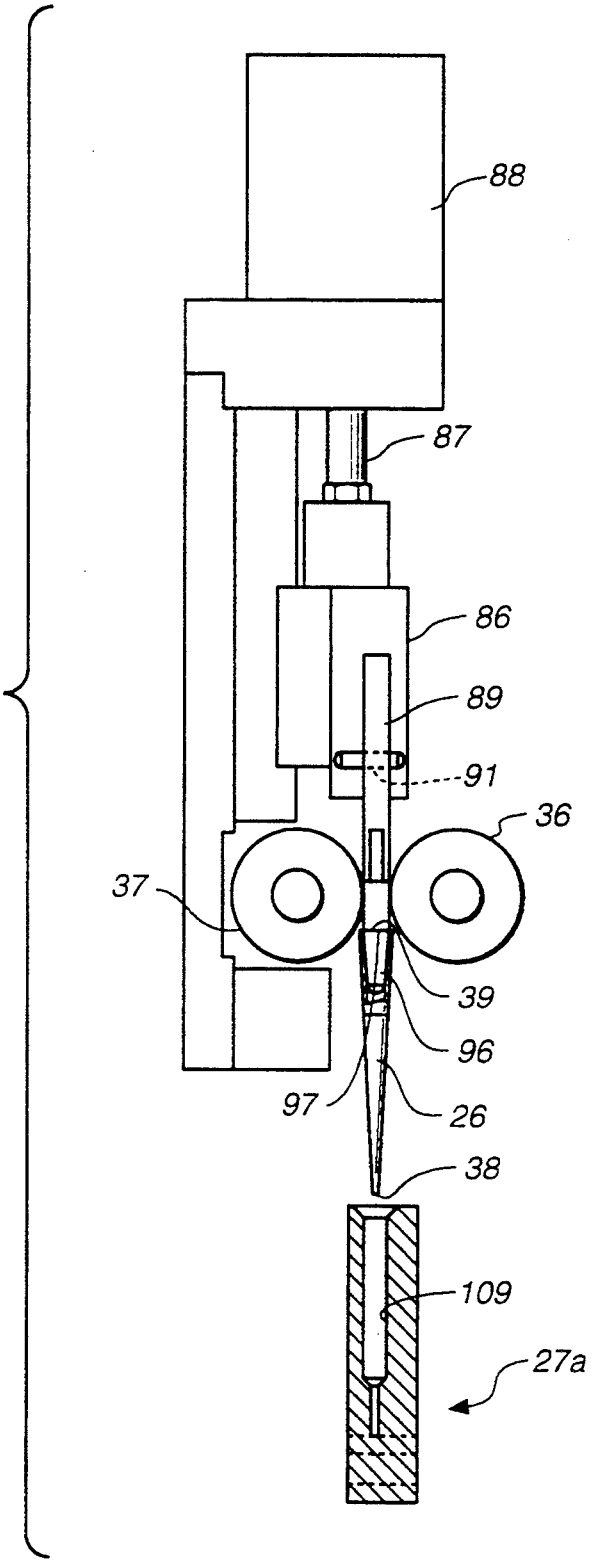
FIG. 12A is an end elevation view of the assembly of FIG. 12 taken substantially along the plane of line 12A—12A.

In spacer assembly **24*a* of FIGS. 10, 11 and 12, a different pivot structure is used to separate the tips from the side-by-side contact into a spaced apart alignment. Thus, each spacer element 89 is pivotally mounted by pins 91 to a pusher member 86, but the central two spacer elements 89 are fixed, for example, by a second pin 201 to member 86 so that they will not pivot. Instead of employing a single roller, spacer assembly 24*a* of the present invention has two rollers 202, which engage the spacer elements at opposite ends of the array of elements. When rollers are in the position of FIG. 10 below pins 91, the spacer elements are pivoted toward the center of the array and are limited in their spacing by lower lands 98 so as to correspond to the spacing of the pipette tips on roller assembly 23*a***.

Actuator 88 extends piston 87 to drive pusher member 86 and the spacer elements 89 carried thereby toward rollers 36 and 37. FIG. 11 illustrates the spacer elements as the rollers reach pins 91. It will be seen that the ends 96 are fully inserted into open ends 39 of the pipette tips so that shoulders 97 on the spacer elements are engaged with ends 39 to enable pushing of the same transversely to the roller assembly. The assembly of spacer elements, however, has not opened up or changed its longitudinal spacing along rollers 36 and 37 and the pipette tips are not aligned with bores 109 in nest assembly **27*a***.

FIG. 12 shows piston 87 fully extended and rollers 202 engaging the upper ends of spacer elements 89. Upper lands 99 have a width dimension sufficient to allow the assembly to be squeezed together slightly to the FIG. 12 position. This causes splaying of the spacer elements in opposite directions or opening up of the spacer elements and alignment of tips 38 with nest bores 109. At the same time, the spacer assembly **24*a* has pushed the pipette tips through or beyond rollers 36 and 37 so that the tips may now gravitate into bores 109 by falling off of tapered ends 96. It should be noted that arms 204, on which rollers 202 are mounted, are biased towards each other by an amount sufficient to enable spreading or opening of the spacer elements as the rollers move toward upper lands 99. Again, the spacer elements 89** are dimensioned so that the opposed sides of the large ends of the pipette tips can be squeezed inwardly to permit passage between the two rollers.

Figure 14:
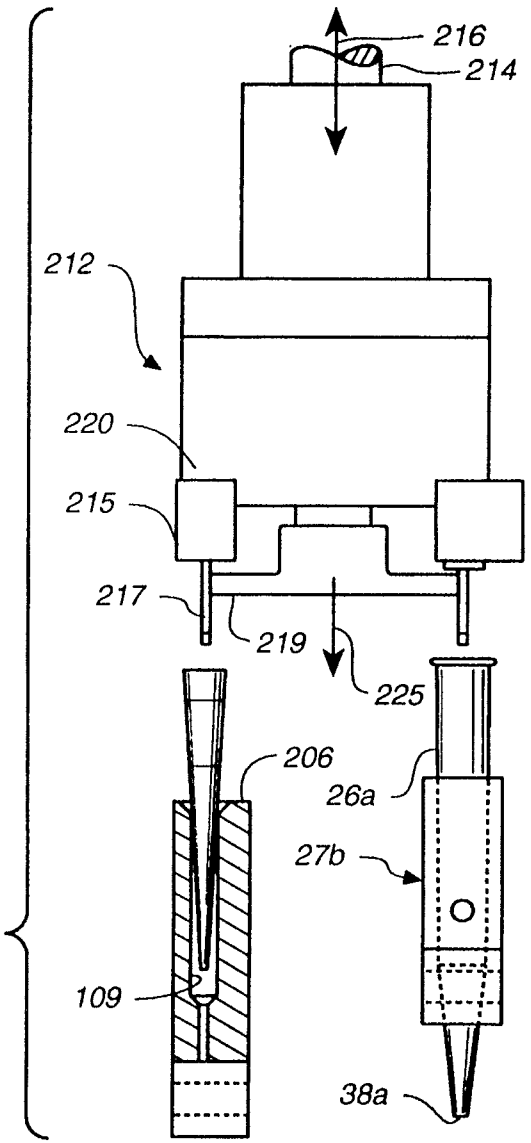
FIG. 14 is an end elevation view of the assembly of FIG. 13.
Figure 13:
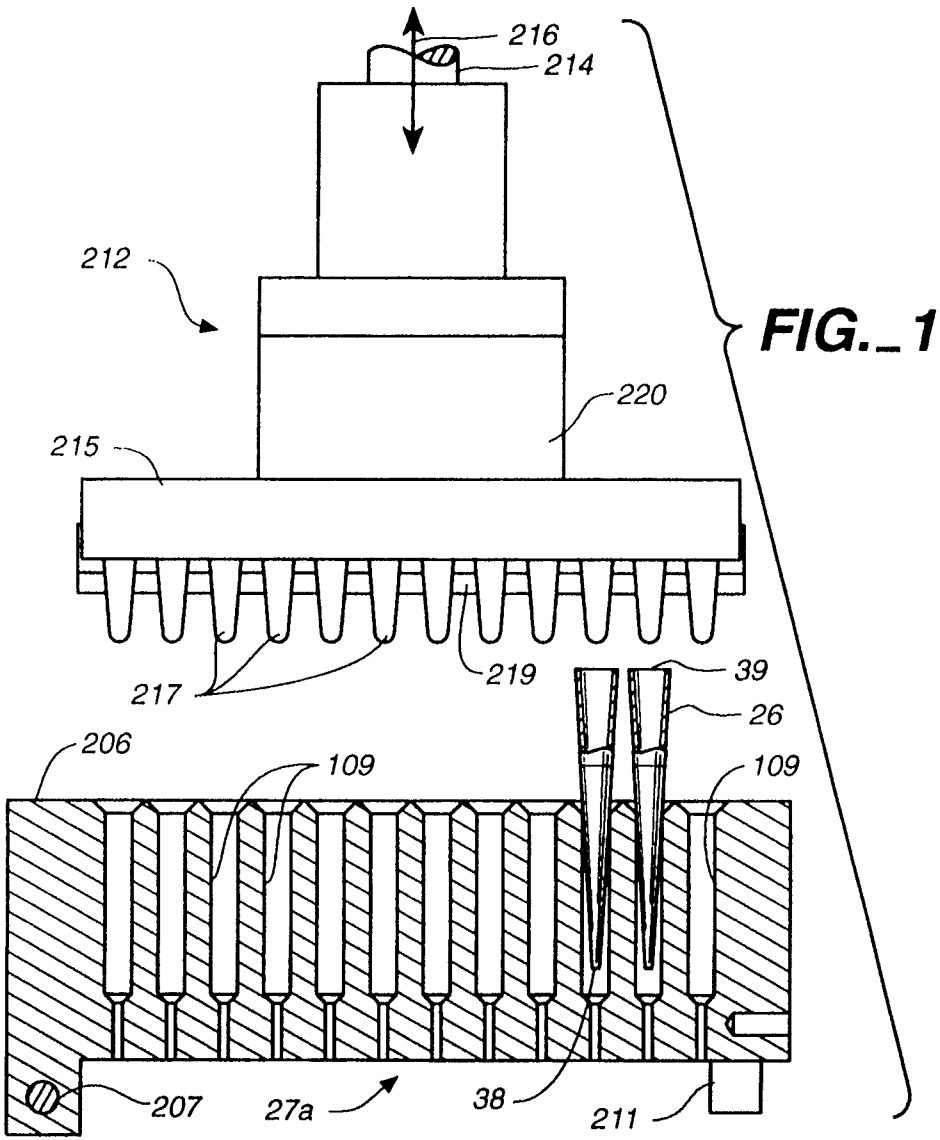
FIG. 13 is a fragmentary, side elevation view, in cross-section of the nest assembly of FIG. 9 and of an associated transfer assembly.

The nest assembly of automated loading apparatus **21*a* is formed to hold pipette tips 26 in the proper spacing for insertion into rack 28, but with the pipette tips extending upwardly above upper edge 206 of nest 27*a*, as seen in FIGS. 13 and 14. Thus, bores 109 in nest 27*a* are formed with a diameter which will not permit passage of the tips therethrough, as was the case with nest 27. Transfer of the tips to the pipette rack or box 28 is accomplished, therefore, by a combination of displacement of nest 27*a* and picking up of the tips from nest 27*a* by robot transfer assembly 200**.

First, nest **27*a* is moved from the solid line position of FIG. 12 to the phantom line position of FIG. 12 by pivoting the nest about a pivot pin 207 as the nest is moved out from under pusher assembly 24*a* by an actuator, not shown. Thus, nest assembly 27*a* is moved in a direction out of the page in FIG. 12, and a roller element 208 rolls on an incline ramp 209 to allow the nest to reach a horizontal position for support on stop or ledge member 211. Translation of the nest outwardly from under alignment and pusher assembly 24*a* allows the open upper ends 39 of the pipette tips in the nest to be exposed for insertion of a transfer assembly, generally designated 212**, into the upper ends of the pipette tips.

Transfer assembly 212 is carried by robot arm 213 and includes an actuation cylinder that allows raising and lowering of a "Z" shaft or vertically displaceable member 214, as indicated by arrows 216. Mounted to Z shaft 214 is a gripper member 215 which carries a plurality of downwardly depending tapered transfer protrusions 217, which are dimensioned to be inserted into open ends 39 of the pipette tips. Moreover, the taper on members 217 is such that the members will resiliently wedge in the open ends 39 so as to produce flexing or ovalizing of the tip end as a result of the interference fit therewith that will enable lifting of tips 26 from nest 27*a*. The gradual taper insures that tips of slightly differing internal diameter will all be picked up. It will be recalled that the tips 26 are relatively light in weight and are resilient. Accordingly, protrusions 217 preferably are plate-like protrusions, as can be seen from FIG. 14, which extend or distend ends 39 substantially along one plane, for example, a plane parallel to the nest, to effect a sufficient ovalizing and wedging of the tips to enable lifting of the tips out of the nest.

Once the members 217 are wedged down in opening 39 of the tips, robot arm 214 will retract the transfer assembly 212 to lift the tips out of nest 27*a*. The robot then moves transfer assembly 212 to a position over the desired row of rack 28. As will be seen in FIG. 9, rack 28 is shown oriented at a 90 degree orientation from that of the racks in FIGS. 1 through 8 on conveyor 141, and in this case the conveyor is operating in the opposite direction to the conveyor of FIGS. 1–8. Thus, the robot assembly 200 will rotate transfer assembly 212 with the pipette tips thereon by 90 degrees and position the tips over a desired row of openings 81. Since the robot can rotate 360 degrees about a vertical axis, the racks and conveyor could easily be angularly oriented in any position. The robot then can lower transfer assembly 212 until the small diameter ends 38 of the tips are immediately above openings 81, at which point a stripper member 219 driven by actuator 220 is moved in a downward direction, as indicated by arrow 225 in FIG. 14, to strip tips 26 off of the transfer protrusions 217 and urge them downwardly into openings 81 in rack 28.

Figure 9:
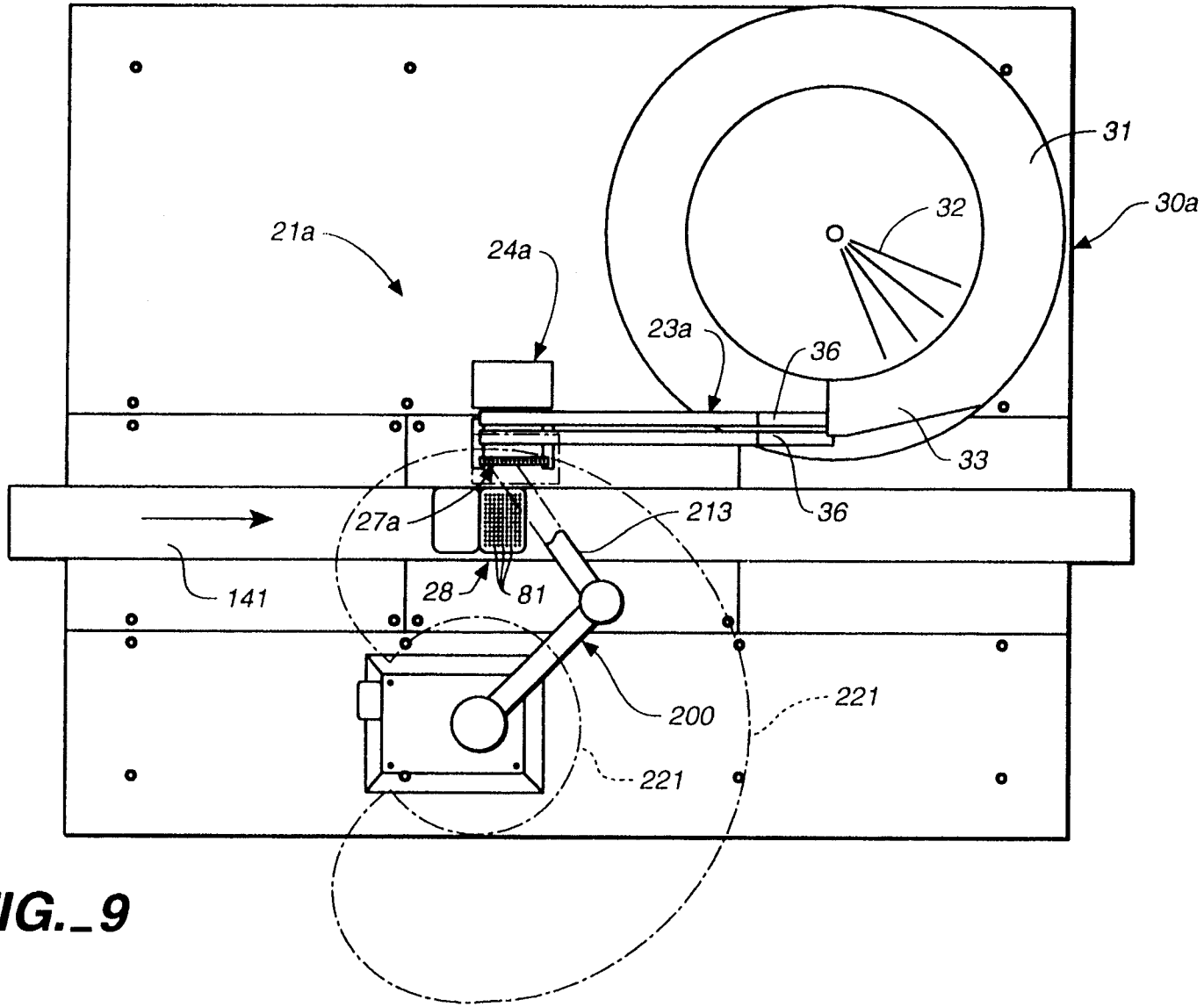
FIG. 9 is a top plan view of an alternative embodiment of the present apparatus for automated loading of pipette tips into a packaging container.

While the transfer process between the nest and the rack is occurring, the actuator for the nest will reciprocate the nest back to a position underneath the roller assembly for the next row of pipette tips. As shown in FIG. 9, the phantom line 221 defines the envelope of area which robot assembly 200 can operate and deliver tips at pre-programmed locations. Robot assemblies having the necessary capabilities for transfer of tips between nest 27*a* and racks 28 are well known in the art, and a suitable robot assembly for the automated tip loading apparatus 21*a* is manufactured by Seiko Instruments of Torrance, California and sold as a model TT8010.

Using the assembly of FIGS. 9–14, a row of twelve pipette tips can be loaded into a rack once every 20 seconds and about 17,000 pipette tips can be loaded in containers or racks per hour. It would be understood that container positioning and release assemblies will be associated with conveyor 141 so as to position containers serially in an indexed position on conveyor 141 for loading using the apparatus of the present invention.

Figure 15:
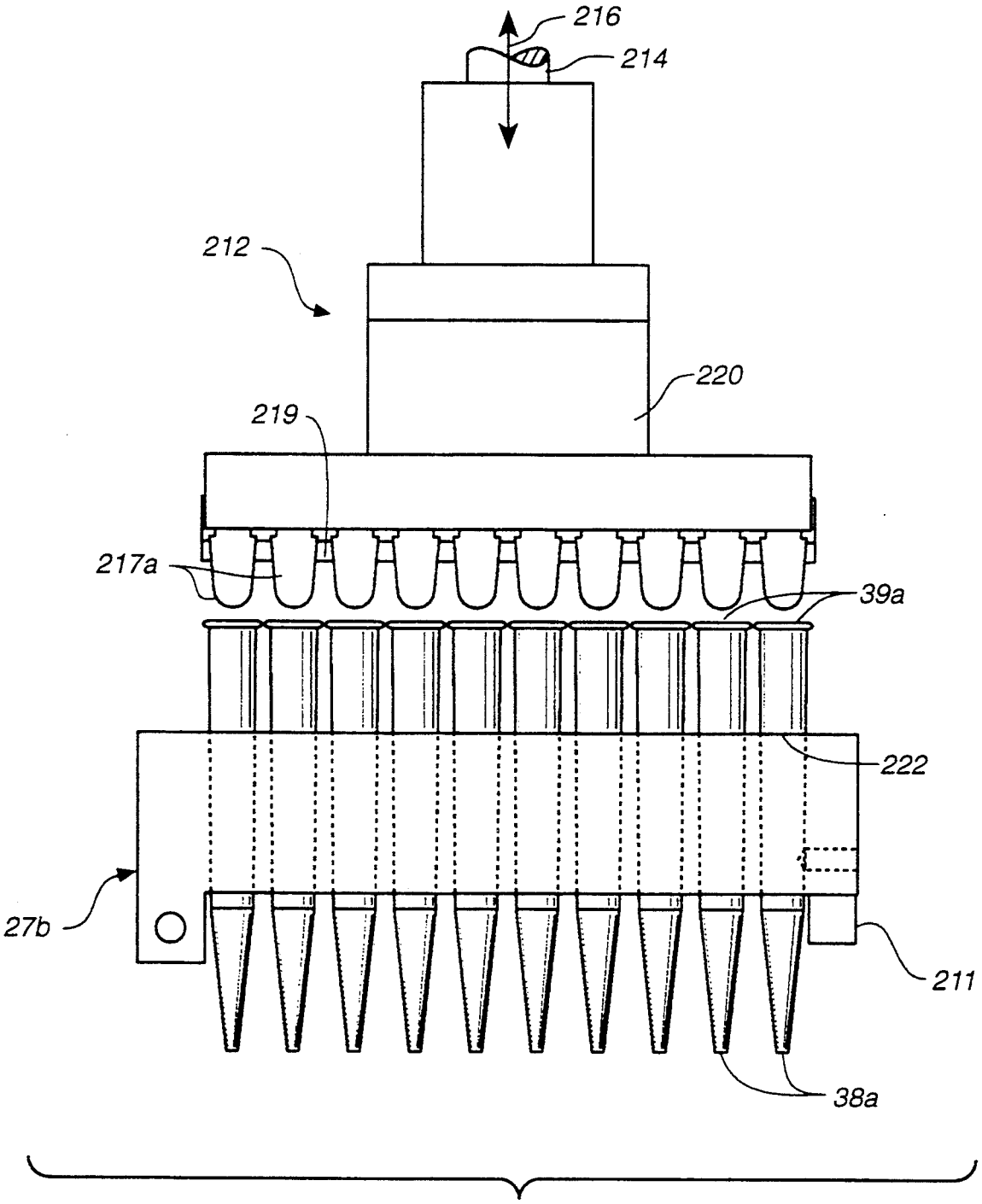
FIG. 15 is a side elevation view of an opposite side of the transfer assembly of FIG. 13 shown as used with larger pipette tips.

As can be seen from FIGS. 14 and 15 transfer assembly 212 preferably is formed so that it can be used to transfer pipette tips of two different sizes. Thus, a second gripper member 215*a* can have protrusions 217*a* mounted thereto and formed for wedging insertion into open upper ends 39*a* of pipette tips 26*a*. Tips 26*a*, for example, can be 1 milliliter tips which are loaded into racks (not shown) of 10 tips per row with 10 rows per tip. Nest 27*b* supports tip 26*a* by shoulders 222 with the small diameter ends 38*a* extending through nest 27*b*. As described above, tips 26*a* are stripped from protrusions 217*a* by stripper 219.

Having described the apparatus of the present invention, the method of automatically loading pipette tips into a pipette tip storage, transportation and dispensing container can be described. The present method includes the step of depositing a plurality of randomly oriented pipette tips 26 into tip-orienting means 22, such as a feeder 30 and roller assembly 23. While the pipette tips are supported on the tip-orienting means, the next step is to reorient the tips from a random orientation to the same or a common orientation, preferably in side-by-side, substantially parallel, contacting, tip-down relationship to the tip-orienting assembly. In the preferred form, feeder 30 separates the tips, orients them in a near horizontal orientation and feeds them onto counter-rotating and inclined roller assembly 23, which completes the reorientation employing the combined effects of gravity, counter-rotation and the tapered configuration of the tips.

After reorientation of the tips into a common orientation and a spacing determined by the tip diameters, the tips are separated from contact with each other by a distance substantially equal to the spacing at which they are to be loaded into tip rack 28. Thus, a spacer assembly 24 engages and displaces the tips longitudinally of roller assembly 23 to a predetermined spacing, e.g., the spacing of tip-receiving openings 81 in container 28.

Finally, while tips 26 are spaced apart, they are transferred from the tip orienting assembly 22 and particularly rollers 36 and 37 to openings 81 in container 28. This transferring step can occur directly, but most preferably occurs through the use of an intermediate transfer nest assembly 27.

What is claimed is:

1. An apparatus for automated loading of elongated members into a container comprising:

an orienting assembly formed to automatically reorient and support a plurality of randomly oriented elongated members into a common, side-by-side, substantially parallel, contacting orientation; and a spacer assembly mounted proximate said orienting assembly and having a plurality of spacer elements mounted for movement into interengagement with said elongated members as supported on said orienting assembly in said orientation, said spacer elements being further mounted for movement while interengaged with said elongated members to separate said elongated members from said orientation to a predetermined spacing from each other, and said spacer assembly further being movable to displace said elongated members while in said predetermined orientation into one of said container and a transfer assembly mounted proximate said spacer assembly.

2. The apparatus as defined in claim 1 wherein, said elongated members are tubular pipette tips tapering from a large diameter end to a small diameter end; and said orienting assembly is a tip-orienting assembly including a vibratory feeder formed to receive randomly oriented pipette tips and formed to feed said pipette tips in a near horizontal orientation out a feeder discharge, and said tip-orienting assembly further includes a pair of elongated rollers mounted in spaced-apart relation to receive said pipette tips on upper surfaces thereof from said feeder discharge, said rollers being spaced apart by a distance less than said large diameter ends and greater than said small diameter end of said pipette tips for support of said tips therebetween with said small diameter end depending downwardly between said rollers.

3. The apparatus as defined in claim 2 wherein,
said rollers are counter-rotating in a direction tending to lift said tips supported thereon and said rollers have longitudinal axis inclined to a horizontal plane by an amount sufficient for gravitation of said tips into side-by-side contact.

4. The apparatus as defined in claim 3 wherein,
said tip spacer assembly is formed with spacer elements dimensioned for insertion into said large diameter end of said pipette tips,
said spacer elements are movable along the space between said rollers to said predetermined spacing, and
said tip spacer assembly is movable transversely of said rollers to displace said pipette tips between and beyond said rollers.

5. The apparatus as defined in claim 4 wherein,
said tip spacer assembly displaces said tips into a transfer assembly positioned proximate and below said rollers and comprised of a nest assembly having a plurality of bores spaced in side-by-side spaced-apart relation at a distance substantially equal to the desired spacing of said pipette tips in said container means.

6. An apparatus for automated loading of hollow, tapered, pipette tips into container means comprising:
a pair of tip-orienting, elongated roller means mounted in spaced apart relation by a distance sufficient to enable said tips to be supported therebetween by large diameter ends with small ends of each of said tips extending between said roller means;
a spacer assembly mounted proximate said roller means and having a plurality of spacer elements each aligned between said roller means and mounted for movement transverse to said roller means into releasable interengagement with large diameter ends of each of said tips as supported on said roller means, said spacer assembly being mounted for displacement of said pusher elements, while interengaged with said tips, to align said small ends of each of said tips in a predetermined alignment, and said spacer assembly further being mounted for movement of said spacer elements in a direction toward said roller means while said small ends of each of said tips is in said predetermined alignment until said large ends of each of said tips passes between said roller means.

7. The apparatus as defined in claim 6 wherein,
at least one of said roller means is mounted for rotation in a direction producing upward displacement of tips supported therebetween; and
roller drive means coupled to rotate said one of said roller means.

8. The apparatus as defined in claim 7 wherein,
each of said roller means are mounted for rotation, and
said roller drive means is coupled to counter-rotate said roller means in directions tending to produce lifting of said tips as supported between said roller means.

9. The apparatus as defined in claim 8 wherein,
said roller means have longitudinal axes each mounted at an angle inclined to the horizon by an amount sufficient to produce gravitation of said tips into side-by-side contact with each other.

10. The apparatus as defined in claim 9 wherein,
said roller means are each mounted at an angle inclined to the horizon in the range of about 10 to about 15 degrees.

11. The apparatus as defined in claim 9, and
adjustment means mounting said roller means for selective adjustment of the spacing of said roller means from each other.

12. The apparatus as defined in claim 11 wherein,
said adjustment means is formed for adjustment of the spacing between said roller means while said roller means are rotating.

13. The apparatus as defined in claim 9 wherein,
said roller means are provided as rollers having inwardly stepped diameters along the length of said roller means in a downwardly inclined direction in a position in advance of said spacer assembly; and
tip deflector means positioned proximate and above said roller means at said inwardly stepped diameter to deflect tips off said roller means which are supported on said roller means in an orientation other than with said small ends depending downwardly between said roller means.

14. The apparatus as defined in claim 9, and
hold-down means extending along the space between said roller means in advance of said spacer assembly and at a position above and sufficiently close to said tips to prevent said tips from lifting up and out from between said roller means.

15. The apparatus as defined in claim 6 wherein,
each of said spacer elements is formed for insertion into an interior bore in each of said tips, said spacer elements having a width dimension in a direction transverse to said roller means enabling inward displacement of said large ends of said tips toward said spacer elements as said spacer elements push said tips between said roller means.

16. The apparatus as defined in claim 15 wherein,
each of said spacer elements includes a shoulder extending transversely to the direction of movement of said spacer elements during pushing of said tips past said roller means and formed to interengage with an opposed surface on said tips.

17. The apparatus as defined in claim 15 wherein,
a plurality of said spacer elements are mounted for movement in a direction along the space between said roller means to effect alignment of said tips in said predetermined alignment.

18. The apparatus as defined in claim 17 wherein,
said plurality of said spacer elements are pivotally mounted for movement along the space between said roller means.

19. The apparatus as defined in claim 18 wherein,
said spacer assembly includes alignment means producing pivoting of said spacer elements during movement of said spacer assembly toward said roller means.

20. The apparatus as defined in claim 19 wherein,
said spacer elements are pivotally mounted to a common member for pivoting in a direction producing separation of the small ends of said tips.

21. The apparatus as defined in claim 20 wherein,
said roller means are inclined to the horizon; and
said pivotally mounted spacer elements pivot in a direction toward the downward inclination of said roller means.

22. The apparatus as defined in claim 20 wherein, at least one of said pivotally mounted spacer elements pivots in a direction opposed to the remainder of said pivotally mounted spacer elements.

23. The apparatus as defined in claim 17 wherein, said spacer assembly includes a roller assembly engaging said spacer elements to effect movement thereof along said space during movement of said spacer assembly toward said roller means.

24. The apparatus as defined in claim 23 wherein, said roller assembly is provided by a roller element engaging at least one of said plurality of pusher elements.

25. The apparatus as defined in claim 20 wherein, said spacer elements are mounted to said common member to prevent movement along said space until said spacer elements are moved into interengagement with said tips, and said spacer elements engaging said tips have a length sufficient to insure alignment of said tips with said spacer elements upon pivoting of said spacer elements.

26. The apparatus as defined in claim 6 and, nest means positioned proximate and below said roller means and defining a plurality of bores formed to receive said tips therein when said tips are in said predetermined alignment.

27. The apparatus as defined in claim 26 wherein, said spacer elements are formed for gravity release of said tips into said nest means when said tips are moved past said roller means.

28. The apparatus as defined in claim 27 wherein, said nest means includes a plurality of bores positioned in a spacing corresponding to a spacing of tip receiving openings in said container means into which said tips are to be loaded.

29. The apparatus as defined in claim 28 wherein, said bores in said nest means are formed for gravity-induced sliding of said tips along the length thereof.

30. The apparatus is defined in claim 29 wherein, said nest means includes tip retention means mounted for selective retention of said tips in said bores and release of said tips for gravity sliding from said nest means into said container means.

31. The apparatus as defined in claim 30 wherein, said retention means is formed to retain said tips in said nest means in a retracted position for movement of said nest over said container means and to retain said tips in said nest means in an extended position immediately above said openings in said container means before release of said tips for gravitation into said container means.

32. The apparatus as defined in claim 31 wherein, said retention means is provided by a movable bar assembly extending transversely across said bores to prevent passage of said tips therebeyond.

33. The apparatus as defined in claim 32 wherein, said bar assembly includes a pair of spaced apart transversely extending bars mounted to a rocker arm assembly.

34. The apparatus as defined in claim 26, and nest transfer means coupled to said nest means and formed for displacement of said nest means between a receiving position for receipt of said tips from said roller means and a discharge position for gravity discharge of said tips from said nest means into said container means.

35. The apparatus as defined in claim 34 wherein, said nest transfer means is formed for displacement of said nest means to a plurality of side-by-side discharge positions each aligned with one of a plurality of rows of openings in said container means.

36. The apparatus as defined in claim 34, and conveyor means positioned proximate said nest means, and said container being mounted on said conveyor means.

37. The apparatus as defined in claim 36, and container indexing means formed to position said container on said conveyor means in indexed relation thereto to receive tips from said nest means in said discharge positions.

38. The apparatus as defined in claim 26 wherein, said nest means is formed with bores having a transverse dimension supporting said tips in said nest means with the large ends thereof extending above said nest means.

39. The apparatus as defined in claim 38, and a tip transfer assembly mounted proximate said nest means and formed to releasably grip said tips while supported in said nest means, said tip transfer assembly being mounted for movement to remove said tips from said nest means and transfer said tips to a position aligned with said container means, and said transfer assembly being formed to release said tips when aligned with said container means.

40. The apparatus as defined in claim 39 wherein, said tip transfer assembly includes a plurality of tapered tip wedging elements formed for insertion into said tips until said tapered tip wedging elements wedge into interference engagement with the large ends of said tips, and said tip transfer assembly includes a stripping element mounted for movement relative to said tip gripping elements to strip said tips off said tip gripping elements.

41. The apparatus as defined in claim 6, and feeder means formed to automatically feed tips onto said rollers at a position remote of said spacer assembly.

42. The apparatus as defined in claim 41 wherein, said feeder means is provided by a vibratory feeder formed to discharge tips onto an upper surface of said roller means in a near horizontal orientation.

43. A method of loading of elongated members into a container having a plurality of spaced-apart member-receiving openings comprising the steps of:

depositing a plurality of randomly oriented members onto orienting means;

while said elongated members are supported on said orienting means, reorienting said elongated members into the same orientation and into side-by-side, substantially parallel, contacting relation on said orienting means;

thereafter separating said elongated members from contact with each other to space said elongated members from each other by a distance substantially equal to the spacing of said openings from each other; and while said elongated members are spaced apart, transferring said elongated members from said orienting means to said openings in said container.

44. The method as defined in claim 43 wherein, said elongated members are hollow, substantially cylindrical pipette tips; and said depositing step is accomplished by depositing said pipette tips into a vibratory feeder.

45. The method as defined in claim 44 wherein, said pipette tips each having a large diameter end and taper to a small diameter end; and said reorienting step is accomplished by gravity-reorienting said pipette tips with said small diameter end depending down from said orienting means.

46. The method as defined in claim 45 wherein, said reorienting step includes supporting said pipette tips by said large diameter end between a pair of rollers spaced apart by a distance less than said large diameter end.

47. The method as defined in claim 46 wherein, said reorienting step is accomplished in part by rotating at least one of said rollers in a direction lifting said pipette tips.

48. The method as defined in claim 47 wherein, said reorienting step is accomplished in part by counter-rotating said rollers while longitudinal axes thereof are inclined to the horizon.

49. The method as defined in claim 43 wherein, said elongated members are hollow pipette tips; and said separating step is accomplished by engaging said pipette tips with tip spacing means, and while engaging said pipette tips, displacing said pipette tips laterally by said tip spacing means to effect separation.

50. The method as defined in claim 43 wherein, said elongated members are hollow pipette tips; and said transferring step is accomplished by pushing said pipette tips from said orienting means.

51. The method as defined in claim 50 wherein, said transferring step is accomplished by pushing said pipette tips from said orienting means into nest means formed to maintain the spacing of said pipette tips, and thereafter transferring said pipette tips from said nest means into said openings.

52. The method as defined in claim 51 wherein, said step of transferring said pipette tips from said nest means to said openings is accomplished by gravity propelling said pipette tips through said nest means into said openings.

53. The method as defined in claim 52 wherein, during said gravity propelling step, stabilizing the orientation and spacing of said pipette tips while positioned immediately above said openings.

54. The method as defined in claim 52 wherein, said step of transferring said pipette tips from said nest means to said openings is accomplished by engaging said pipette tips while positioned in said nest means and lifting said tips from said nest means to transfer said tips to said openings.

55. The method as defined in claim 43 wherein, said elongated members are tubular pipette tips tapered from a large diameter end to a small diameter end;

said depositing step is accomplished by depositing said pipette tips on tip orienting means including a pair of inclined rollers spaced apart by a distance less than the diameter of said large diameter end and greater than the diameter of said small diameter end; and said reorienting step is accomplished in part by counter-rotating said rollers in a direction tending to lift said pipette tips from between said rollers and tending to combine with gravity to reorient said pipette tips into side-by-side, contact on said rollers with said small diameter end depending down from said rollers.

56. The method as defined in claim 55 wherein, said separating step is accomplished by inserting a spacer element into said large diameter end of said pipette tips while supported in side-by-side contact on said rollers and moving said spacer element in a direction along the space between said rollers.

57. The method as defined in claim 56 wherein, said transferring step is accomplished by pushing said pipette tips transversely of said rollers until said pipette tips are pushed beyond and are free of said rollers.

58. The method as defined in claim 57 wherein, said separating step is accomplished by inserting a spacer element having a transverse dimension less than the interior diameter of said pipette tips at said large diameter end, and by pivoting said spacer element after said inserting step; and said pushing step is accomplished by pushing each of said pipette tips with said spacer element until said pipette tips flex inwardly by an amount sufficient to allow said pipette tips to pass beyond said rollers.

59. The method as defined in claim 55 wherein, said depositing step is accomplished by depositing said pipette tips into a vibratory feeder;

said reorienting step is accomplished by feeding said pipette tips with said feeder onto said inclined rollers; and said transferring step is further accomplished by pushing said pipette tips between said rollers and into a nest assembly formed to maintain the spacing of said pipette tips achieved during said separating step.

60. The method as defined in claim 59 wherein, said transferring step further includes transferring said pipette tips from said nest assembly to said openings.

61. The method as defined in claim 43 wherein, said elongated members are tubular members; and said transferring step is accomplished by interengaging each of said tubular members with a pusher element dimensioned to permit inward flexing of said tubular members, and pushing said tubular members with said pusher element past a support portion of said orienting means until said tubular members flex by an amount sufficient to allow said tubular members to be released from said orienting means.

* * * * *